US005259690A

United States Patent [19]

Legge

[11] Patent Number: 5,259,690

[45] Date of Patent: Nov. 9, 1993

[54] SCAFFOLD COUPLERS

[76] Inventor: Philip Legge, Drovers, Southend Common, Nr Henley-on-Thames, Oxon RG9 6JN, England

[21] Appl. No.: 636,630

[22] Filed: Jan. 2, 1991

[30] Foreign Application Priority Data

Jan. 4, 1990 [GB] United Kingdom ..... 9000191

[51] Int. Cl.[5] ..... E04G 7/00

[52] U.S. Cl. ..... 403/385; 403/400; 403/396; 285/373; 24/270; 24/273

[58] Field of Search ..... 403/385, 400, 391, 396; 285/283, 419, 373, 42.0, 409, 243, 252; 248/229, 225.3, 231.5; 24/339, 270, 273

[56] References Cited

U.S. PATENT DOCUMENTS

| | | | |
|---|---|---|---|
| 2,752,174 | 6/1956 | Frost | 285/420 X |
| 3,113,791 | 12/1963 | Frost et al. | 285/373 X |
| 3,999,825 | 12/1976 | Cannon | 285/373 X |
| 4,438,958 | 3/1984 | DeCenzo | 285/373 X |
| 4,639,979 | 2/1987 | Polson | 285/373 X |
| 4,660,870 | 4/1987 | Donley | 285/419 |
| 4,784,514 | 11/1988 | Pantev | 403/391 |
| 4,817,897 | 4/1989 | Kreusel | 403/385 X |

FOREIGN PATENT DOCUMENTS

| | | | |
|---|---|---|---|
| 161789 | 10/1953 | Australia | 403/385 |
| 806051 | 6/1951 | Fed. Rep. of Germany . | |
| 621163 | 1/1927 | France | 24/270 |
| 846381 | 6/1939 | France | 403/385 |
| 957134 | 8/1949 | France | 403/385 |
| 998362 | 9/1951 | France . | |
| 1000733 | 10/1951 | France . | |
| 1238931 | 7/1960 | France . | |
| 1397747 | 3/1965 | France . | |
| 333846 | 9/1936 | Italy | 24/339 |
| 448188 | 5/1949 | Italy | 403/385 |
| WO88/06222 | 2/1988 | PCT Int'l Appl. . | |
| 258529 | 5/1949 | Switzerland | 403/385 |
| 413320 | 12/1966 | Switzerland | 403/400 |
| 602055 | 10/1945 | United Kingdom . | |
| 693500 | 7/1953 | United Kingdom | 403/385 |
| 981681 | 12/1959 | United Kingdom . | |
| 1418017 | 12/1972 | United Kingdom . | |
| 2200420 | 1/1987 | United Kingdom . | |
| 2227785 | 1/1989 | United Kingdom . | |
| 2219342 | 6/1989 | United Kingdom . | |

*Primary Examiner*—Eric K. Nicholson
*Assistant Examiner*—Heather Chun
*Attorney, Agent, or Firm*—Davis, Bujold & Streck

[57] ABSTRACT

A scaffold coupler is actuated by an over-center lever mechanism. The scaffold coupler, which is of resilient plastics, includes a hand lever 13 which is hinged to a jaw 12 that closes upon a base member 11 to clamp tight a scaffolding tube 15. A hook member 14 hinged to the lever 13 engages with a lip 19 of the member 11 so that depression of the lever 13 urges the jaw 12 hard onto the tube 15 and actuates the clamping mechanism by pulling the hook-hinge 22 through 'over-center' alignment with the lever-jaw hinge 21 and the hook-lip engagement 'hinge' 23. The base-jaw surface 17 subtends more than 180 degrees to snap fit with the tube 15, and opening of the closure jaw 12 is limited by a projection 20 (or otherwise, FIG. 7 ) for support of the tube 15 (FIG: 2). Closing of the jaw 12 may be tripped by entry of the tube 15 (FIG. 6 ), and the jaws may be abrasive-surfaced (FIG. 5 ) to improve grip. The lever 13 may be selectively locked in the actuated condition (FIGS. 19 to 24), and other configurations of over-center lever mechanism are possible (FIGS. 25 to 29). Right-angle, swivel and sleeve couplers (FIGS. 9, 10–13, 17–18) include two over-center mechanisms, whereas a putlog coupler (FIGS. 14–15, 16) includes one, with the second pair of jaws actuated by one or more levers 63 that bear on the tube 62 clamped by the first pair.

16 Claims, 19 Drawing Sheets

SCAFFOLD COUPLERS

This invention relates to scaffold couplers

Scaffolding is commonly constructed of lengths of steel or aluminium-alloy tube that are intercoupled with one another to form an open structural framework configured to the needs of the application. The intercoupling of the tubes is effected by scaffold couplers that are located where the tubes cross one another, or meet end to end, in the framework, each coupler being clamped to the two crossing or meeting tubes to hold them rigidly together.

Existing scaffold couplers take a variety of forms but are of steel and are generally clamped to the tubes by means of one or more nuts and bolts. Such couplers suffer from the disadvantages that they are heavy and that their fastening and unfastening is time consuming and is inconvenient in requiring use of a spanner or podger (tommy bar). Two hands are normally required to hold the coupler during the initial stages of fastening and the nuts and bolts are often corroded, all making the operation difficult to carry out effectively and giving rise to a risk of the coupler and/or the spanner being dropped causing waste of time in its recovery and possible danger to persons below. Furthermore, the nuts and bolts of the couplers are subject to over- or under-tightening, with consequent variation, and therefore uncertainty, in the load-carrying capacity of the coupling: there is generally no clearly-visible sign of the degree of tightening of the nut, by which it might be possible to be warned of danger of a loose or over-tight coupling.

It is one of the objects of the present invention to provide a scaffold coupler that may be used to overcome, or at least reduce, the above disadvantages of existing couplers.

According to the present invention, a scaffold coupler having jaws to embrace a tube or other scaffolding element includes an over-centre lever mechanism that is selectively actuable to close and clamp the jaws onto said element.

The lever mechanism may involve a lever that is angularly displaceable for actuating the mechanism to close and clamp the jaws onto said element, means for establishing a first effective hinge connection with the actuating lever, means for establishing a second effective hinge connection between the lever and one of the jaws, and means for establishing a third effective hinge connection with the other jaw, displacement of said lever for actuating the mechanism as aforesaid causing the first hinge connection to be moved into alignment with the second and third hinge connections against a resilient bias and to snap through such alignment and be retained there with the jaws clamped onto said element.

The mechanism as specified in the preceding paragraph may take a form in which the third effective hinge connection is established by a selectively disengageable connection between said other jaw and a linking member that is hinged by said first hinge connection to the actuating lever, and in which said displacement of the actuating lever acts via said disengageable connection to pull the two jaws towards one another so as to close and clamp them more tightly onto said element as said first hinge moves into said alignment. Alternatively, it may be the second hinge connection that is provided by a selectively-disengageable connection, the first hinge connection in this case being between the actuating lever and a further lever that is hinged by the third hinge connection to the other jaw. As another alternative, the mechanism may take a form in which the third effective hinge connection is a selectively-disengageable connection between the two jaws themselves, and the first effective hinge connection is between the actuating lever and said other jaw. Furthermore, as yet another alternative, the first effective hinge connection may be a selectively disengageable connection between the actuating lever and a linking member that is hinged by the third hinge connection to said other jaw. In all four cases, the resilient bias may be manifested in the selectively-disengageable connection and/or one or more of the integers interconnected thereby.

The jaws may be defined in two separate, jaw-defining parts that are hinged directly together by means of a discrete hinge connection, but alternatively may be defined in a unitary structure in which relative movement of the jaws is achieved by flexing within that structure. Each jaw may be of a shape to conform to the surface of the tube or other scaffolding element over a substantial part of that surface. Moreover, one of the jaws may be defined by a clamping surface that subtends more than 180 degrees and involves resilience to enable that jaw to be snapped onto the element for initial retention prior to actuation of the lever mechanism to close the jaws and effect clamping. Grip of the jaws may be enhanced by providing them with abrasive surfacing.

The coupler may involve two pairs of jaws, and in this respect the two pairs of jaws may be mounted in the coupler with a fixed orientation with respect to one another for engaging and clamping to respective tubes or scaffolding elements that cross one another and are to be held together by the coupler at a fixed angle, for example at right angles, to one another. Alternatively, the two pairs of jaws may be mounted in the coupler for swivelling relative one to the other; the swivelling may be restricted to a specific angular range, or may be unrestricted. Furthermore, the two pairs of jaws may be aligned side by side with one another to provide a sleeve coupler for coupling tubes or other scaffolding elements together end to end.

According to a feature of the present invention there is provided a scaffold coupler for clamping to tubes or other scaffolding elements to hold them to one another, wherein a base member and a closure member have opposed cylindrically-concave surfaces to define a pair of jaws for gripping a first of said elements, the closure member is hinged to the base member for movement of the closure member towards the base member in closing the jaws upon said first element, and wherein the coupler includes an over-centre lever mechanism that is actuable to close and clamp the jaws onto said first element, and means for clamping the coupler to a second of said elements. The over-centre lever mechanism may involve a hand lever that is hinged to the closure member and a hook member that is hinged to the hand lever and is adapted to engage with a lip or other projection on the base member, the mechanism being actuated to bring about clamping by turning the hand lever about its hinge with the closure member, while the hook member is engaged with the lip or other projection. Furthermore, said means for clamping the coupler to the second element may involve a second pair of jaws.

Where two pairs of jaws are provided as referred to in the two immediately-preceding paragraphs, both may be actuated by an over-centre lever mechanism.

However, where only one of the two pairs of jaws is actuated by the over-centre lever mechanism, the other pair of jaws may include one or more hinged arms that abut the tube or other scaffolding element inserted within said one pair of jaws, in such a manner that said other pair of jaws is closed as said one pair of jaws is engaged and closed upon that element. More generally in this connection, and according to an alternative, independent aspect of the present invention, a scaffold coupler for clamping to first and second tubes or other scaffolding elements to hold them to one another, comprises a first pair of jaws which are for receiving the first element and which are actuable for clamping to the received first element, and a second pair of jaws which are for receiving the second element and which involve one or more hinged arms for abutting the first element when this is received within said first pair of jaws, the arrangement being such that through this abutment by the one or more arms upon the first element, said second pair of jaws are actuated to close upon the received second element in response to the reception and clamping of the first element by said first pair of jaws.

Various forms of scaffold coupler in accordance with the present invention will now be described, by way of example, with reference to the accompanying drawings, in which.

Figure 2:
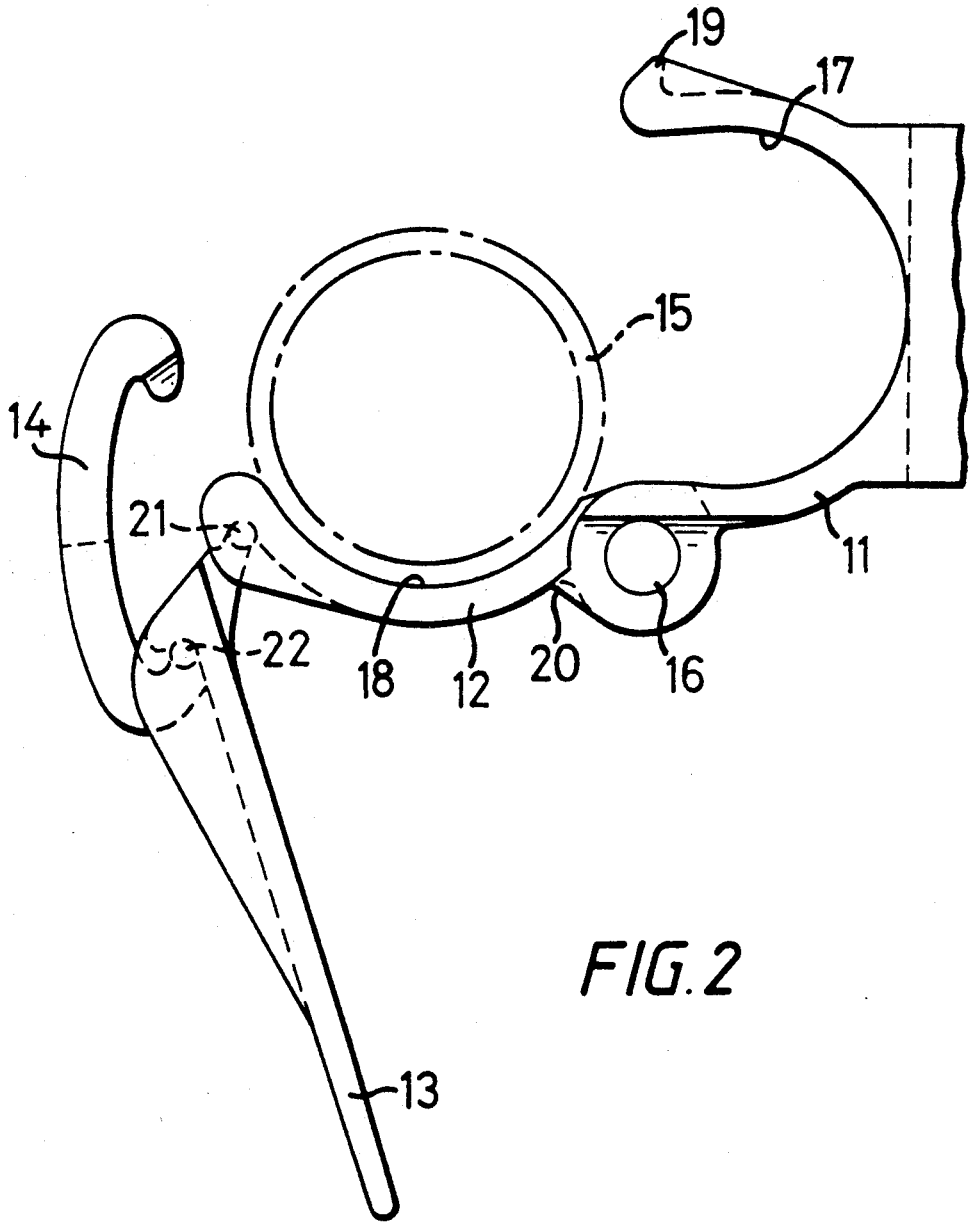
FIGS. 2 to 4 show, in end elevation, a form of jaw assembly that features in scaffold couplers according to the present invention, during successive stages in the clamping of the assembly to a scaffolding tube.
Figure 3:
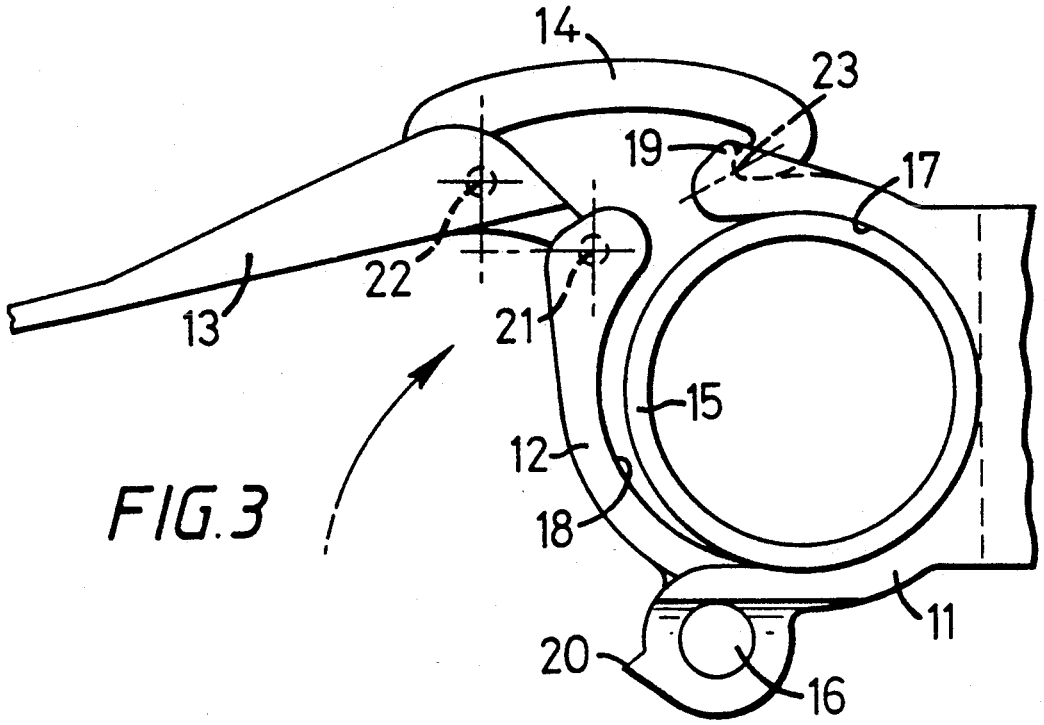
Figure 4:
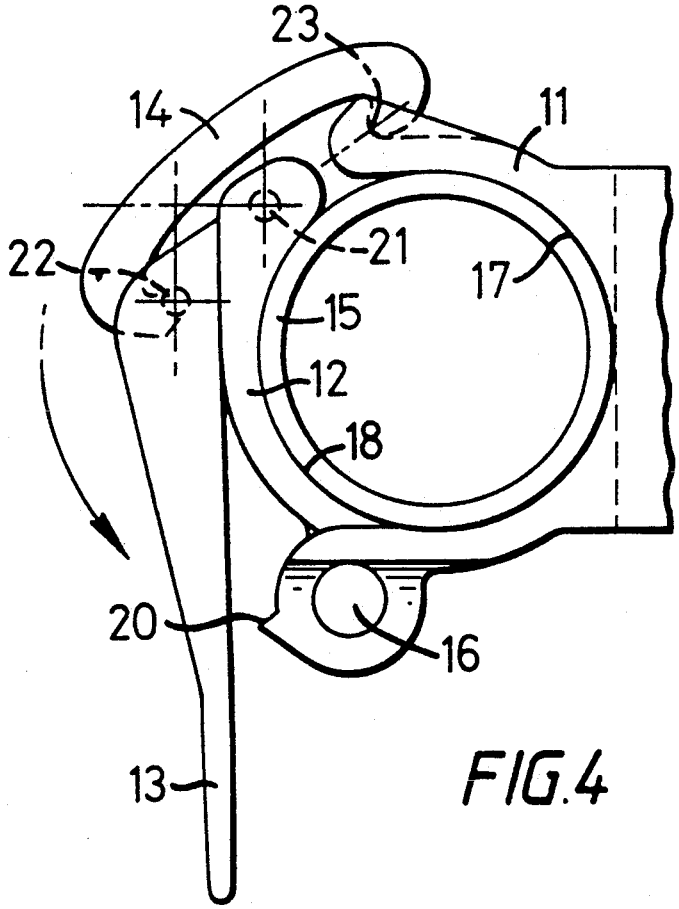
Figure 19:
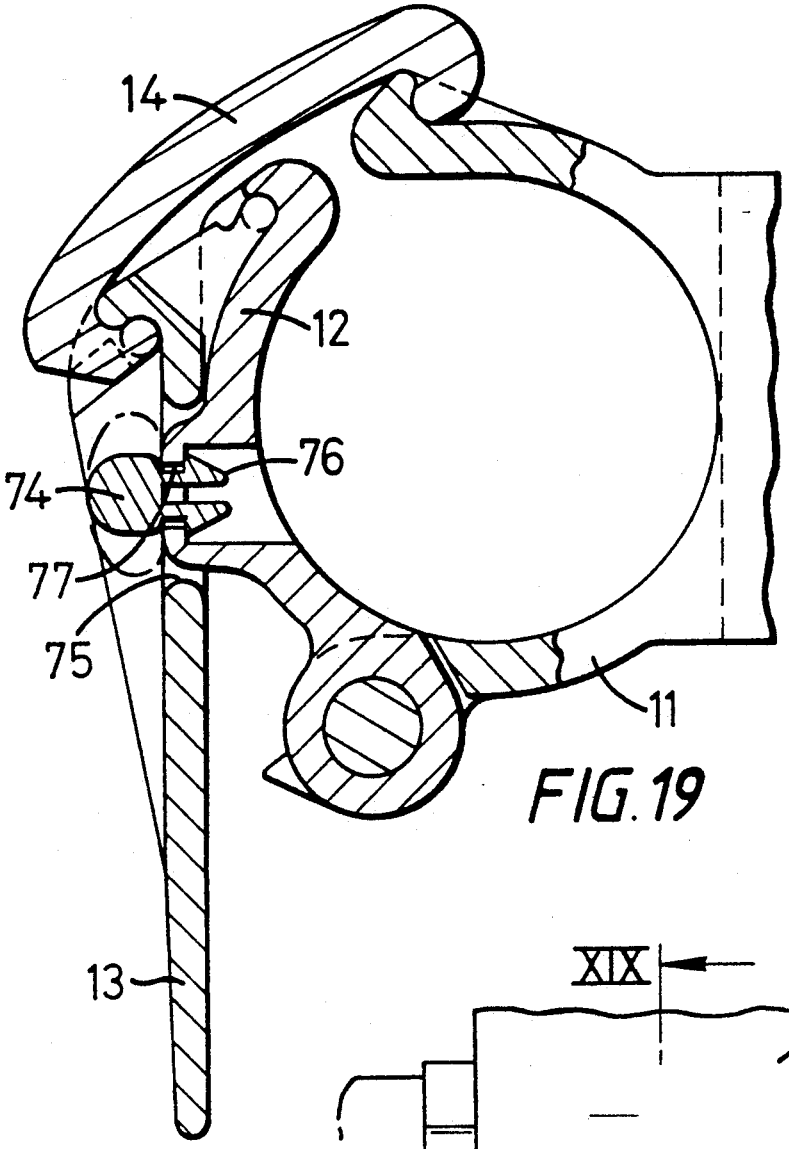
Figure 20:
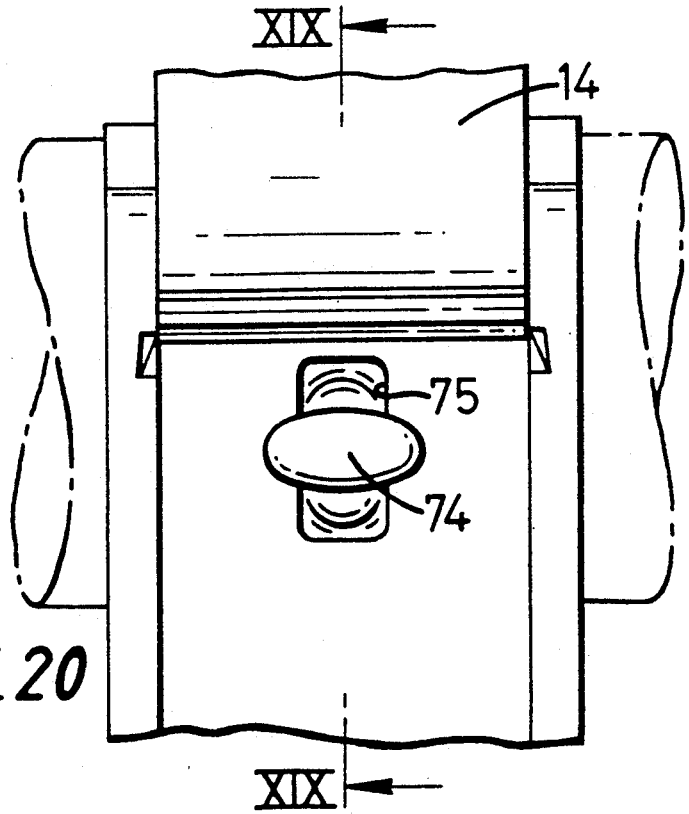
Figure 21:
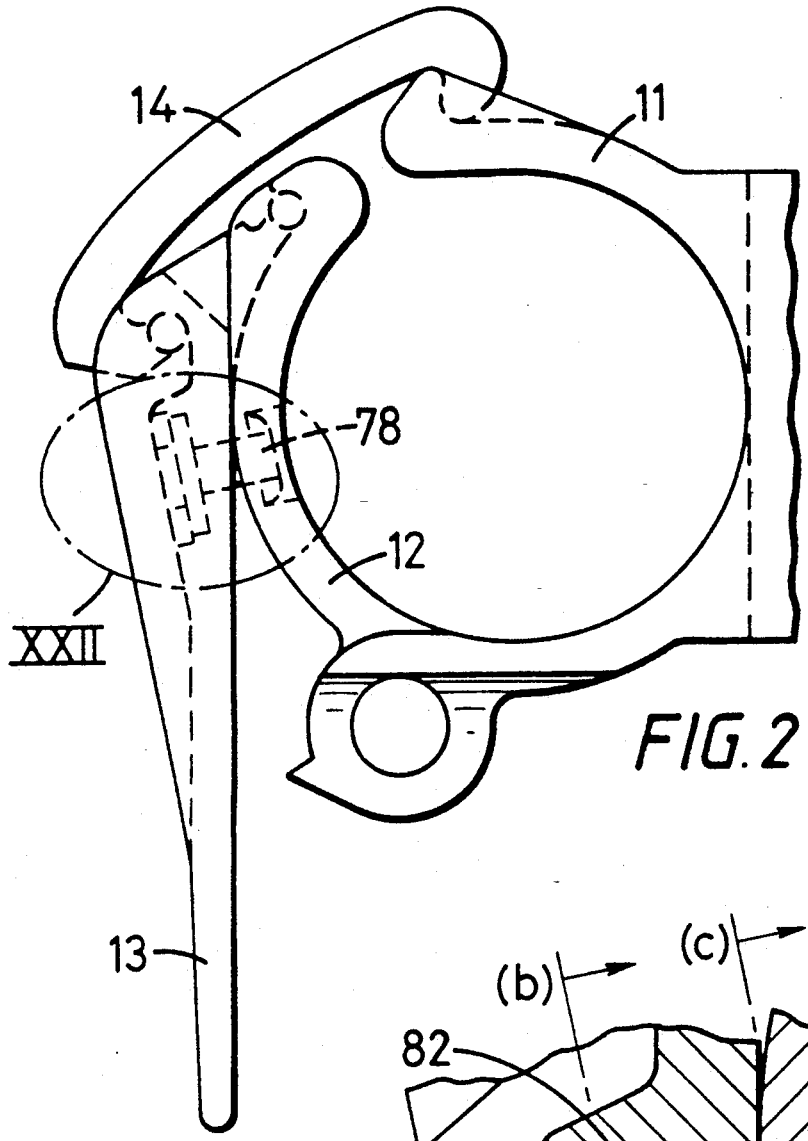
Figure 22:
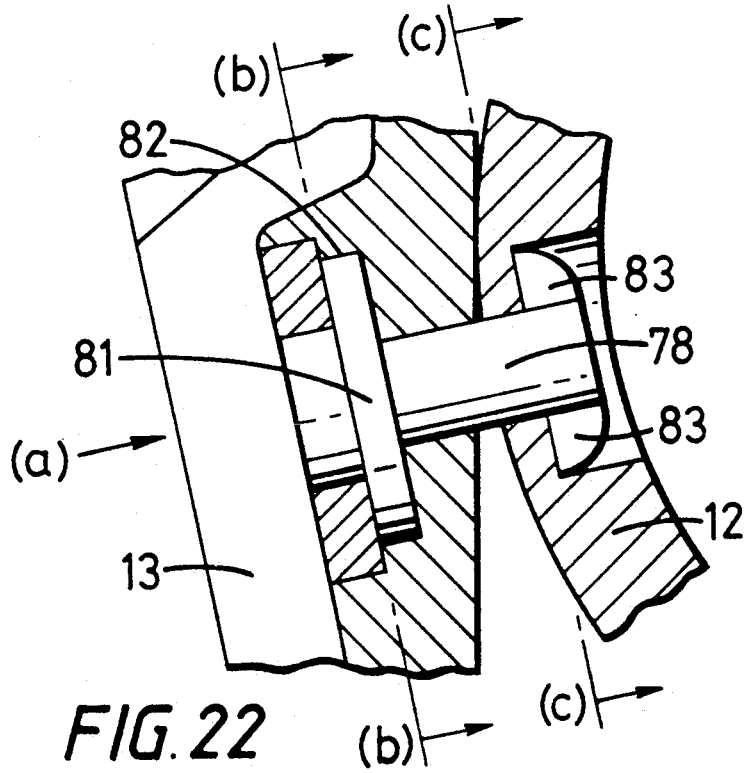
Figure 23A:
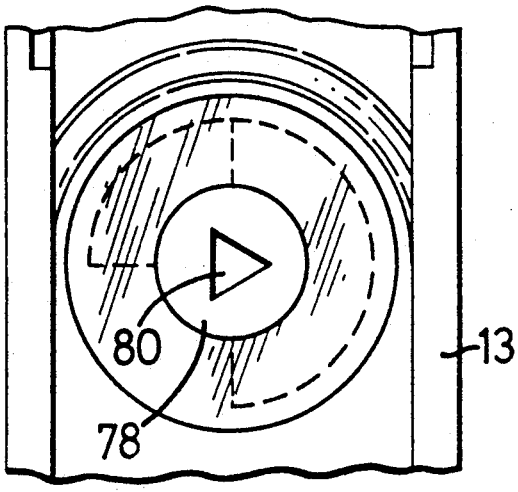
Figure 23B:
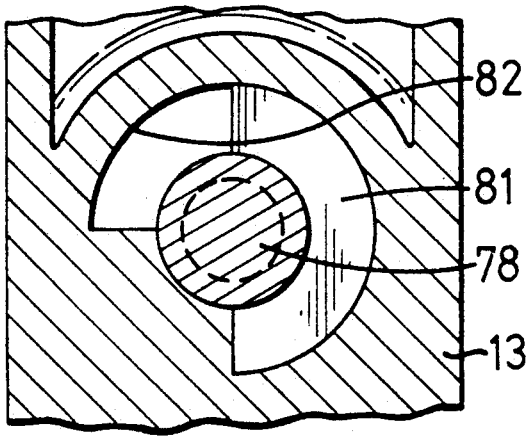
Figure 23C:
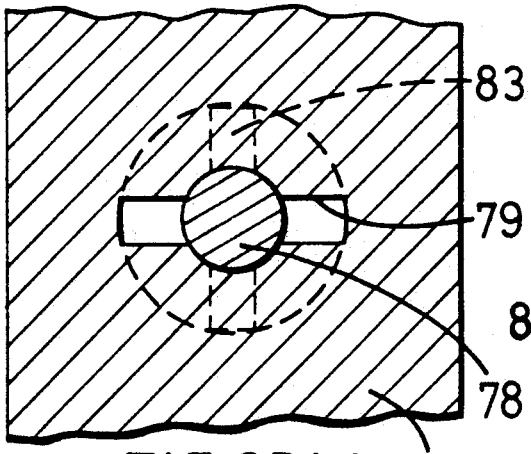

FIGS. 19 and 20 respectively, a sectional side-elevation and a partial end-elevation of a part of a scaffold coupler according to the present invention, incorporating a safety-toggle locking feature, the section of FIG. 19 being taken on the line XIX—XIX of FIG. 20;

FIG. 21 shows part of a scaffold coupler according to the present invention, incorporating an alternative form of locking feature to that involved in the scaffold coupler of FIGS. 19 and 20;

FIG. 22 is an enlarged sectional view of that portion of the coupler shown in FIG. 21 which is enclosed by a broken line XXII;

FIGS. 23(*a*)-(*c*) and 24(*a*)-(*c*) are views taken in the direction of the arrow (a) and on the section lines (b)—(b) and (c)—(c) of FIG. 22, during locked and unlocked settings of the coupler; and FIGS. 25 and 26, 27 and 28 and 29 are illustrative respectively, of three forms of jaw assembly that may be used as alternatives to that of FIGS. 2 to 4, in scaffold couplers according to the present invention.

Four distinct classes of scaffold coupler in accordance with the present invention are shown in the drawings and will be described, namely, a right-angle coupler, a swivel coupler, a "non-load-bearing" or putlog coupler, and a sleeve coupler. Applications of these different classes of scaffold coupler will be outlined with reference to the example of scaffolding structure shown in FIG. 1. This structure is of a conventional access form, providing a platform or walk-way, the section of structure shown being of just two bays long and one lift high. The locations of the couplers are indicated in FIG. 1, but, for clarity, the couplers themselves are not shown.

Figure 1:
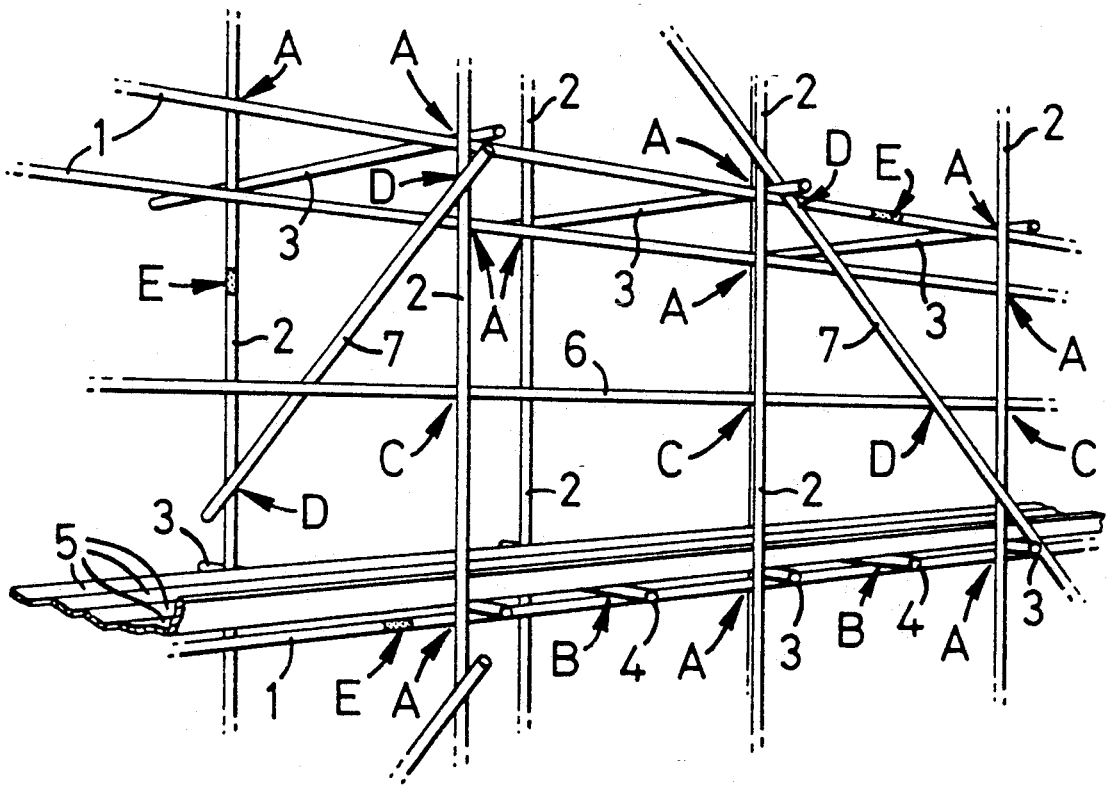
FIG. 1 shows part of a scaffolding structure that serves to illustrate applications of the scaffold couplers to be described.

Referring to FIG. 1, horizontal tubes or ledgers 1 run lengthwise of the structure in two spaced vertical framework-planes, and are clamped to vertical tubes or standards 2 in those planes by right-angle couplers at the locations A where they cross. Standards 2 opposite one another in the two planes are interconnected by short horizontal tubes or transoms 3 using further right-angle couplers at the locations A (more accurately in each case, just above the point where the standard 2 is crossed by, and intercoupled with, the ledger 1). Other transoms 4 (known alternatively in these circumstances as board-bearers) interconnect opposite ledgers 1 of the two framework planes in order to add rigidity and support for platform boards 5 of the structure laid over the transoms 3 and 4; each transom 4 is laid across the respective pair of ledgers 1, and putlog couplers are used at the locations B where they cross to secure them to the ledgers 1. A putlog coupler, or a right-angle coupler, may be used to secure a horizontal tube or handrail 6 to standards 2 as at locations C.

Rigidity of the structure is enhanced by the use of diagonally-oriented tubes or braces 7 that are coupled between ledgers 1 and/or standards 2 using swivel couplers at each location D where a ledger 1, standard 2 or other tube such as handrail 6, is crossed. Furthermore, sleeve couplers may be used to join tubes end to end, as at locations E, to complete the lengths of, in particular, ledgers 1 and standards 2 required in the structure.

Each of the four classes of coupler to be described involves one or more jaw assemblies of the form illustrated in FIGS. 2 to 4. The jaw assembly of FIGS. 2 to 4 will be described before going into specific details of the different coupler classes.

Referring to FIGS. 2 to 4, the jaw assembly comprises four parts, a chassis or base member 11, a closure jaw 12 hinged to the base member 11, a hand lever 13 hinged to the closure jaw 12, and a linking or hook member 14 hinged to the hand lever 13. The base member 11 and the closure jaw 12 define a pair of jaws for clamping the assembly to a scaffolding tube 15. The clamping is achieved through an over-centre lever mechanism formed with the closure jaw 12 by the hinged hand-lever 13 and the hook member 14. The lever 13 and the hook member 14 are used (as illustrated in FIG. 3) to close the jaw 12 onto the tube 15, and, through the over-centre action, pull the jaws onto the tube 15 and hold them clamped to it (as illustrated in FIG. 4).

The base member 11 and the closure jaw 12 are interconnected via a hinge 16 and have inner, cylindrically-concave surfaces 17 and 18 respectively, that are dimensioned to conform closely to the outer surface of the scaffolding tube 15 throughout substantially the whole of the tube-circumference. The jaw surface 17 has a longer arc length than the surface 18 to the extent that it subtends an angle slightly more than 180 degrees between a turned-back lip 19 at one extreme and the hinge 16 at the other. This ensures that the base member 11, which is of a material having some resilience, is a snap-fit with the tube 15, as illustrated in FIG. 3.

Where the tube 15 has already been fixed in the scaffolding structure, the snap-fit feature has the particular advantage of enabling the coupler to be engaged with the tube 15, simply by snapping the base member 11 on to it, without danger of the coupler falling off before the closure jaw is closed and clamping of the assembly to the tube 15 is complete. On the other hand, where the base member 11 has already been secured in some way, and the tube 15 is being presented to it for clamping, the tube 15 can be readily snapped into the member 11 for temporary retention. Moreover, the closure jaw 12 in its fully-open position, rests on a projecting tongue 20 at the hinge 16 and thereby presents a support, as illustrated in FIG. 2, on which the scaffolding tube 15 can be rested prior to being snapped into the base member 11.

Closing of the jaw 12 onto the tube 15 may be effected from the position shown in FIG. 2 by lifting the hand lever 13 up above the tube 15 as illustrated in FIG. 3. This urges jaw 12 through its hinge 21 with the lever 13, to close up towards the tube 15 about the hinge 16, and allows the hook member 14 to be engaged with the turned-back lip 19 as illustrated in FIG. 3; the hook member 14 can be turned about its hinge 22 on the back of the lever 13, to facilitate this engagement. Once the hook member 14 has been engaged with the lip 19, the lever 13 is depressed by hand back towards the jaw 12 about the hinge 21. Continued depression of the lever 13 in this way, pulls the closure jaw 12 about the hinge 16 progressively closer onto the tube 15. The point of engagement of the hook member 14 with the lip 19 acts in this as a pivot centre for the member 14 and the hinge 22; this point of engagement accordingly establishes what is in effect a further (but disconnectable) hinge 23 and is identified in FIGS. 3 and 4 as such.

As the lever 13 continues to be depressed to urge the jaw 12 harder onto the tube 15, the hinge 22 is moved closer towards alignment with the hinges 21 and 23. Maintained depression of the lever 13, finally brings the hinge 22 into that alignment and causes the lever mechanism formed by the interconnected "levers" 12, 13 and 14, to snap "over centre" into the condition in which the jaw 12 is held on the tube 15 without the need for continued hand pressure on the lever 13. The forced movement of the lever 13 to bring the hinge 22 into alignment with the hinges 21 and 23, increases clamping pressure of the jaw surfaces 17 and 18 on the tube 15, as tension in the hook member 14 and the turned-back lip 19, increases.

The tension increases progressively as the force of depression on the lever 13 is increased, and causes a small degree of elastic deformation at the hinge 23 (in the lip 19 and/or hook member 14) sufficient to enable the hinge 22 to be brought onto the "centre" of alignment with the hinges 21 and 23. As the hinge 22 passes, or snaps, through this "centre" against the resilient bias at the hinge 23, the tension relaxes and the deformation reduces elastically. Since force is required to be applied in the opposite direction to take the hinge 22 back through the "centre", the mechanism retains the "over-centre" position, with the tube 15 remaining clamped firmly between the jaw surfaces 17 and 18, when hand pressure on the lever 13 is removed. The location of the lever 13 close in to the jaw 12 provides a readily-visible (even from a distance) indication of the clamped condition of the assembly.

The member 14 remains in tension while the over-centre mechanism is actuated to clamp the jaw surfaces 17 and 18 onto the tube 15. In this regard, the length of the member 14 is chosen to be slightly less than that required untensioned to accommodate the tube 15 in the jaw surfaces 17 and 18 with the mechanism actuated. The tube 15 is thus tightly squeezed between the surfaces 17 and 18 as the jaw 12 continues to be pulled tightly towards the lip 19.

Release of the assembly from the tube 15 is achieved simply by lifting the lever 13. Lifting the lever 13 moves the hinge 22 back through the alignment "centre" of the hinges 21 and 23 against the resilience of the lip 19 and/or member 14, and hinges the jaw 12 away from the tube 15, releasing the clamping pressure. Once the jaw 12 is away from the tube 15 and the hook member 14 released from the lip 19, the base member 11 and the tube 15 can be snapped apart. The assembly can then be clamped elsewhere to the tube 15, or to some other tube, simply by snapping the base member 11 on, engaging the hook member 14 with the lip 19 again, and depressing the lever 13 to actuate the over-centre mechanism to retain the jaws tightly closed onto the tube.

The jaws exert clamping pressure on the tube around substantially the whole of the tube circumference even though the tube may not be truly round. The jaw 12 is in particular pulled in to conform to the tube surface in spite of any ovality of the tube. In this latter respect, scaffolding tubes are in general of uniform circumference independently of ovality, and the jaws of the assembly, because of their extended arcuate length, tend to adapt to the tube shape resiliently. However, a significant range of variations of tube circumference can be accommodated within the flexibility and curved shaping of the hook member 14.

Figure 5:
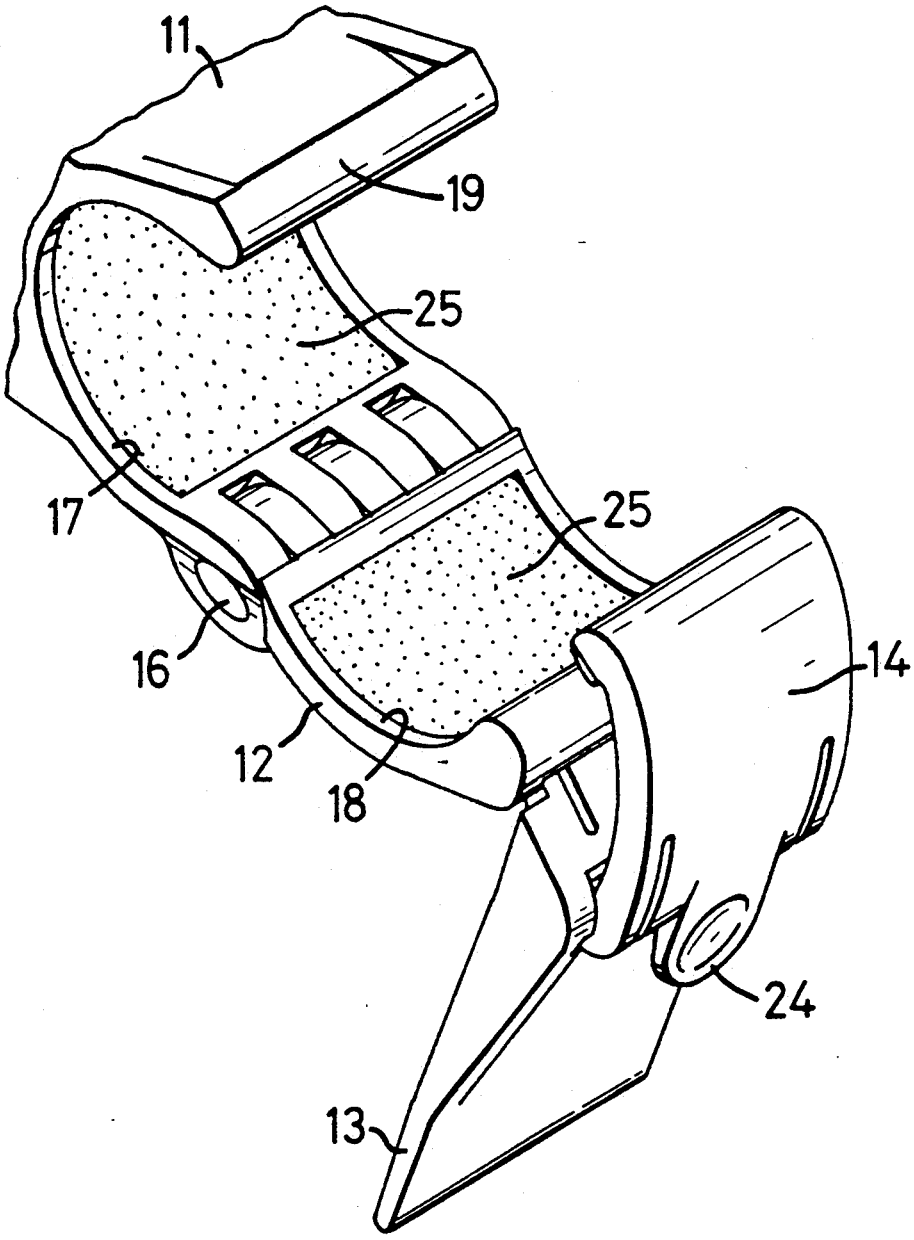
FIG. 5 is a perspective view of a modified form of the jaw assembly of FIGS. 2 to 4.

Engagement and disengagement of the hook member 14 with the lip 19 may be facilitated by the provision of a small rearward extension from the member 14. Such a modification is illustrated in FIG. 5, where a finger-lever 24 projects rearwardly from the hook member 14 for use in rocking the member 14 about its hinge 22 with respect to the lever 13. Finger pressure on the lever 24 allows the hook member 14 to be raised from, and held clear of, the lip 19 during release of the jaws from the scaffolding tube. Similarly, prior to closure of the jaws onto the tube, pressure on the lever 24 can be used to keep the member 14 clear until its release will allow it to fall into engagement with the lip 19.

The jaw surfaces 17 and 18 of the assembly are of a width sufficient to engage the tube over an axial length that is preferably about equal to (though possibly greater than) its diameter; this in general ensures that there is sufficient surface area of jaw-contact with the tube to avoid slip. Grip of the jaws on the tube 15 may, however, be enhanced by increasing the frictional properties of the surfaces 17 and 18. This may be achieved, for example, by coating them with an anti-slip paint, moulding or otherwise incorporating a strip of expanded metal (for example, stainless steel) mesh into them, or lining them with a high-friction material. The use of jaw liners is illustrated in FIG. 5.

Referring to FIG. 5, pads 25 of an abrasive mineral are let into the surfaces 17 and 18 to increase the grip provided. The pads 25 are bonded in place with their peripheral edges recessed deeper The deeper recessing at the edges adjacent the hinge 16, the lip 19 and hinge 21, reduces the likelihood of peeling off when the scaffolding tube is inserted, whereas that at the other, side edges prevents creep of the pads 25 when the coupler is subject to load over a period of time. The abrasive material of the pads 25 may be sized to create friction between the coupler and tube sufficient to carry the full force of the coupler loading, or may be chosen to provide only sufficient initial stiction between them to ensure that, having restrained initial slipping, the coupler locks onto the tube by shackle action.

Figure 6:
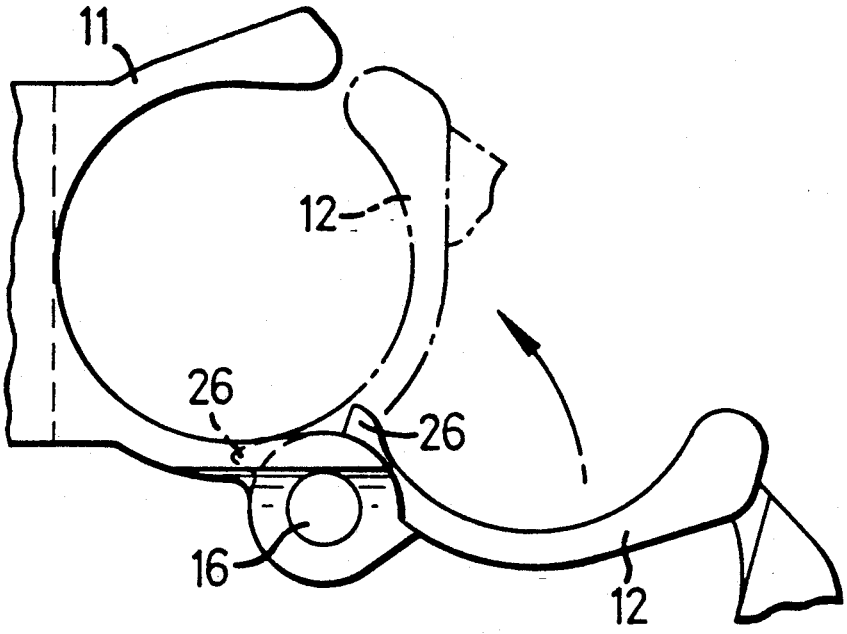
FIG. 6 illustrates a further modification to the jaw assembly of FIGS. 2 to 4.

It may be found desirable to provide for the jaw 12 to close automatically as a tube is entered and snapped into the base member 11. To this end, a small tongue 26 may be provided on the jaw 12 at the hinge 16, as illustrated in FIG. 6, to be contacted by the presented tube and depressed to turn and close the jaw 12 behind it (shown in broken line), when the tube snaps fully home.

Figure 7:
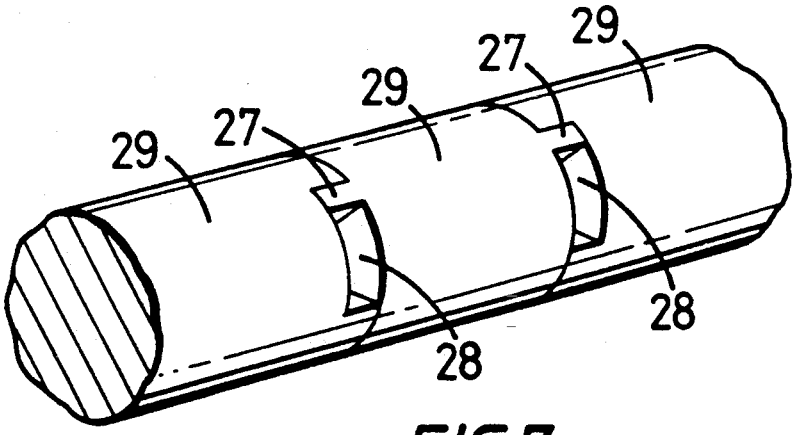
FIG. 7 illustrates an alternative form of hinging that may be used between the jaws of the assembly of FIGS. 2 to 4.

The assembly may be constructed of plastics or metal, or a combination of both plastics and metal; more than one material may be used in an individual component. Plastics components may be injection moulded, and may be of polyethylene or nylon, glass-fibre filled (with fibres of, for example, 2 mm to 3 mm in length). The hinges 16, 21 and 22 may be formed using metal or injection-moulded or extruded plastics pins inserted through aligned holes (possibly metal- or plastics-lined) in projections or other interposed parts of the components. A form of hinge of this kind and used for the hinge 16, is illustrated in FIGS. 2 to 6; this hinge, by virtue of provision of the tongue 20, allows only limited rotation of about 90 degrees. Limitation of rotation can however, as an alternative, be provided by a tongue on the jaw 12 itself, or, as illustrated in FIG. 7, by incorporating into the hinge 16, stops 27 that move in limited-angle sectors 28 of adjacent, interposed lugs 29.

Figure 8:
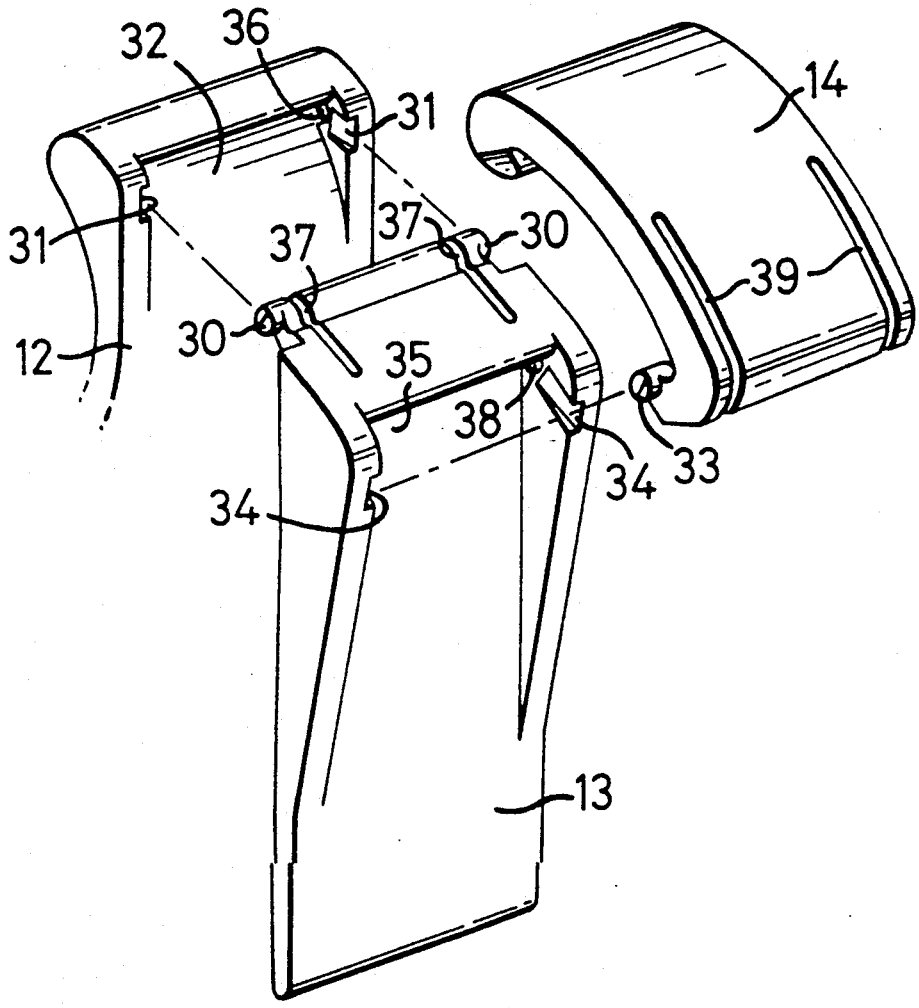
FIG. 8 is an exploded view of part of the jaw assembly of FIGS. 2 to 4, illustrating constructional features thereof.

A form of hinge, which is in the nature of a pin-in-recess joint, and which is used for the hinges 21 and 22, where injection-moulded plastics are involved, is illustrated in FIG. 8, and will now be described.

Referring to FIG. 8, two laterally-projecting spigots or pins 30 are moulded with the lever 13 to engage within respective slots 31 on either side of a small recess 32 at the top of the closure jaw 12. Similarly, two laterally-projecting spigots or pins 33 are moulded with the hook member 14 to engage within respective slots 34 on either side of a recess 35 of the lever 13. Each slot 31 and 34 is of a wedge configuration in that it becomes progressively shallower with increasing depth into the respective recess 32 and 35.

The pins 30 and 33 are chamfered for ease of initial entry into the slots 31 and 34 during assembly. In particular, assembly of the lever 13 with the jaw 12 involves insertion of the pins 30 into the slots 31 and the application of pressure on the lever 13 to force the pins 30 down, against the resilience of the lever 13 and jaw 12, until they leave the ends of the slots 31 and snap into recesses 36 just beyond. The lever 13 is thus held tightly to the jaw 12, but free to hinge relative to it, by the pins 30 trapped in the recesses 36 and forming the hinge 21. Small slits 37 in the region of the pins 30 increase the resilience of the lever 13 to facilitate pin-entry in assembly of the hinge.

The assembly of the hook member 14 with the lever 13 is effected in a similar way. More particularly, the pins 33 are forced down the slots 34 to snap into recesses 38 and be trapped there to hold the member 14 tightly to the lever 13 in the hinge 22. Small slits 39 in the region of the pins 33 enhance resilience of the member 14, in this.

It may be possible to form the pin-in-recess hinge interconnections between the jaw 12, the lever 13, and the member 14, by assembling the components with one another while still hot after moulding. At this time there may be enough yield in the moulded material to allow the pins 30 and 33 to be entered readily into the recesses 36 and 38 (possibly even without the need for the slits 37 and 39), with retention there becoming fulfilled as the material cools. The force applied to the lever 13 in actuating the over-centre mechanism is such as to urge the pins 30 and 33 into their recesses 36 and 38, so the first actuation after manufacture may be used to consolidate their entry.

A right-angled coupler suitable for use at the locations A of FIG. 1 where ledgers 1 and standards 2 cross one another, will now be described with reference to FIG. 9. This coupler incorporates two jaw assemblies of the generic form described above with reference to FIGS. 2 to 4.

Figure 9:
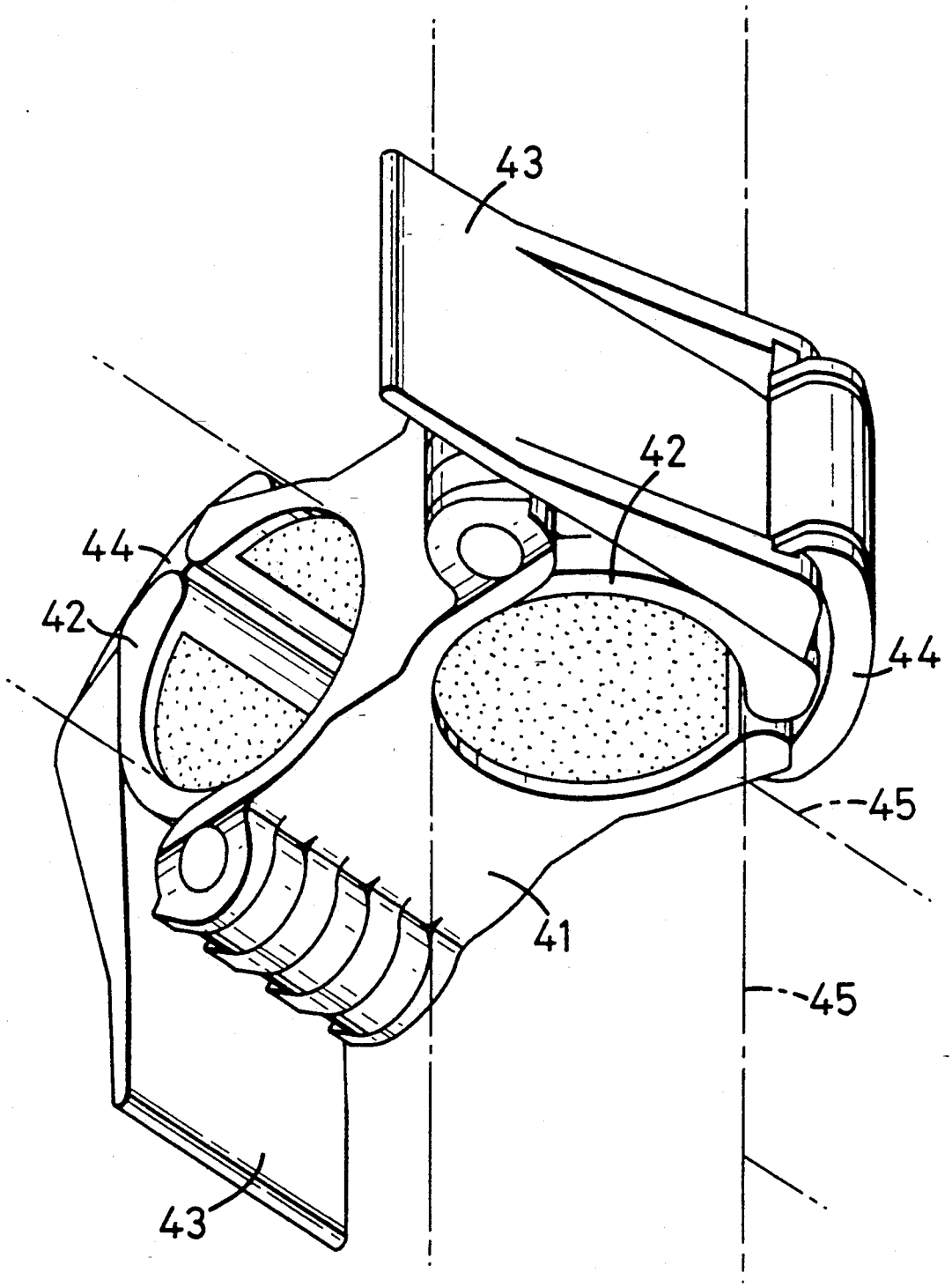
FIGS. 9 and 10 are perspective views of, respectively, a right-angle coupler and a swivel coupler according to the present invention, based on the form of jaw assembly shown in FIGS. 2 to 4.

Referring to FIG. 9, the base members (11) of the two assemblies in this case are formed back to back as one, but rotated through a right angle with respect to one another. The coupling in this case, thus has a unitary central member 41 with the closure jaws 42, levers 43 and hook members 44 of the two sets of jaws operating in orthogonal planes; clearly there are two possible configurations, one as illustrated in FIG. 9, and the other the mirror image of it. The separation of the two sets of jaws from one another through the member 41 is so small that the crossing tubes 45 almost touch one another (for example, only some 1 mm or 2 mm apart) centrally of the member 41, where they cross. This enhances structural strength, and the compact form of the coupler allows for two couplers to be used close one upon the other in the clustering together of three mutually-orthogonal tubes in virtual contact with one another. The design, however, readily allows for there to be a larger spacing between the tubes 45 if a shackle action is to be relied on, or an increased electrical insulation between tubes 45 is desired.

Two jaw assemblies of the generic form described above, are also involved mounted back to back, in the provision of a swivel coupler suitable for use, for example at the locations D of FIG. 1 where a ledger 1 or standard 2 is crossed by a brace 7. Such a swivel coupler is illustrated in FIGS. 10 and 11.

Figure 10:
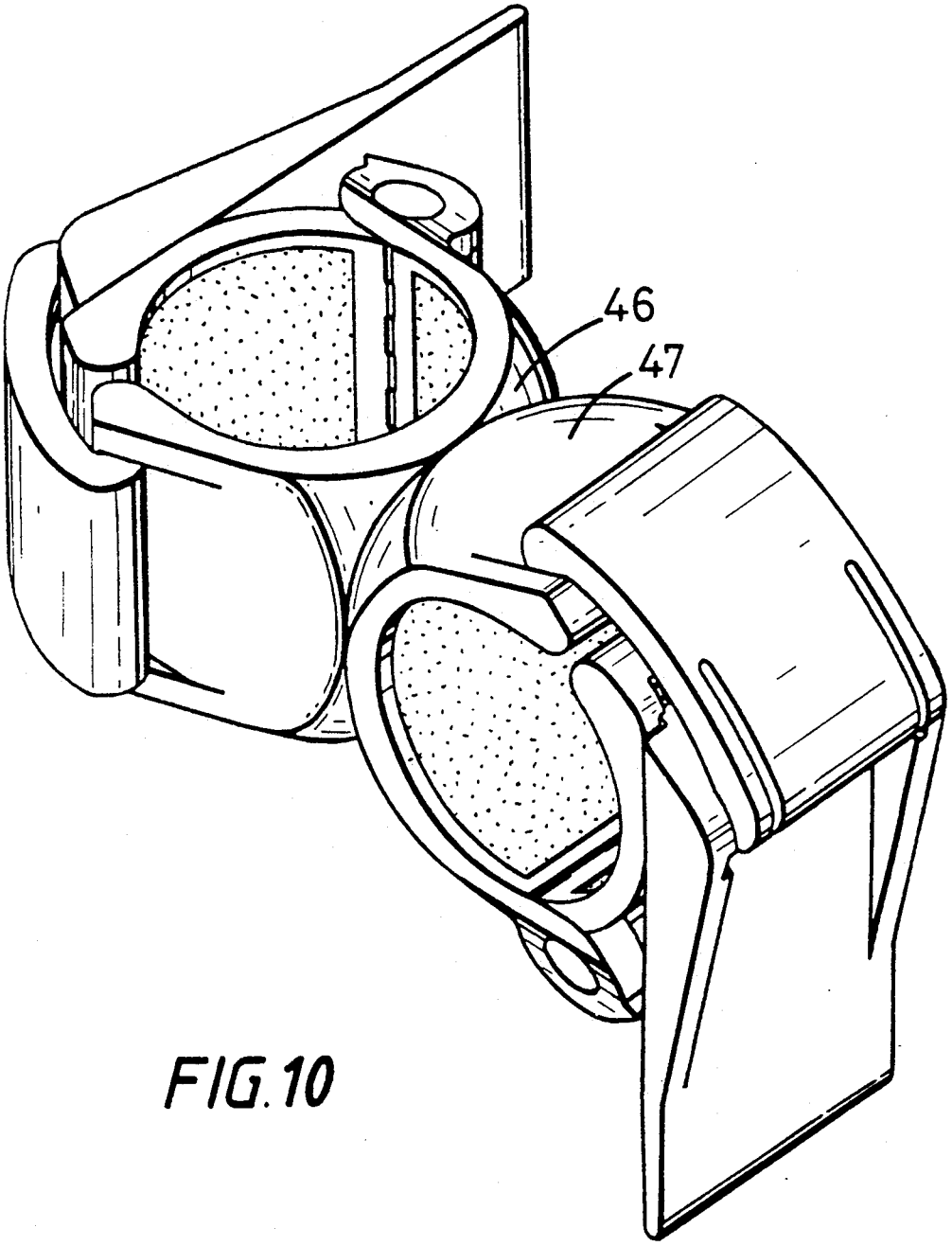
Figure 11:
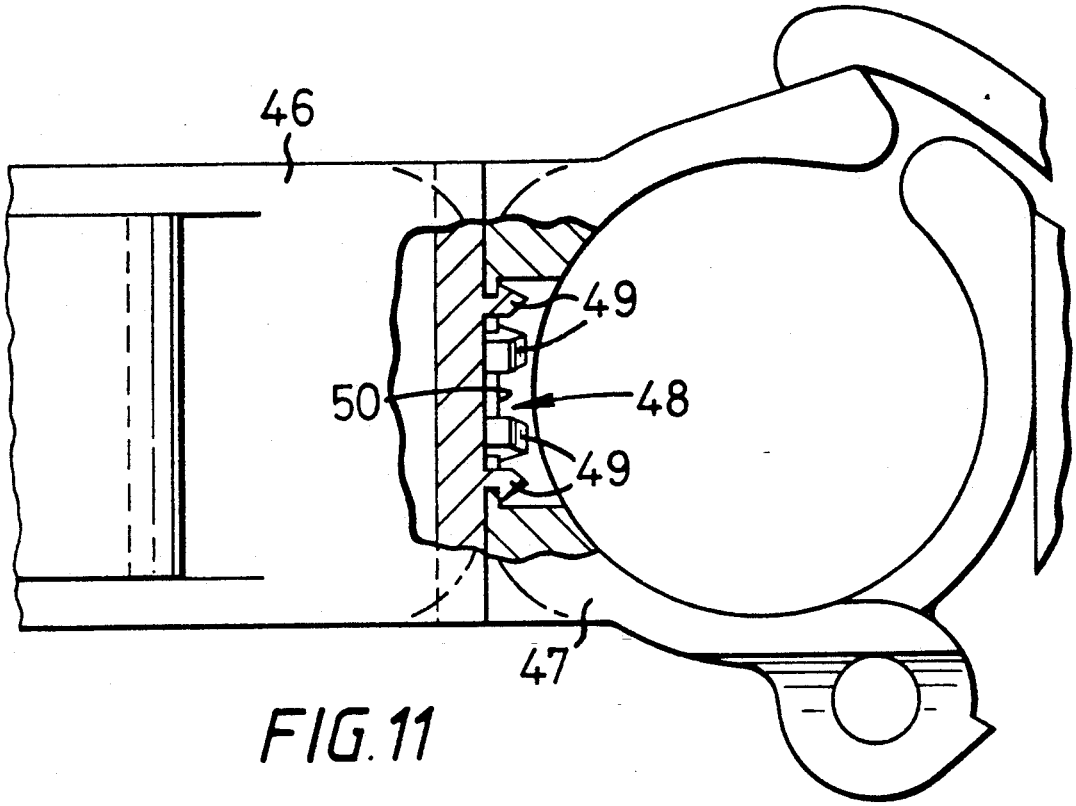
FIG. 11 is a part-sectional side elevation of part of the swivel coupler of FIG. 10, illustrating its swivel mechanism.

Referring to FIGS. 10 and 11, the base members (11) of the two assemblies in this case, namely central base members 46 and 47, remain separate, but intercoupled by a rotating joint 48 (FIG. 11) so that the relative angular-orientation of the operating planes of the two assemblies can be varied. In this respect, and as shown in FIG. 11, the member 46 has a ring of projecting, toothed hooks 49 that engage with an in-turned annular lip 50 of the member 47.

The ring of hooks 49 are squeezed inwardly towards one another to pass through the centre of the lip 50 when the two members 46 and 47 are first brought together, in assembly of the swivel coupler. Once having passed through the lip 50, the hooks 49 spring outwardly to be trapped under the lip 50 and hold the members 46 and 47 together but free to rotate with respect to one another.

Figure 12:
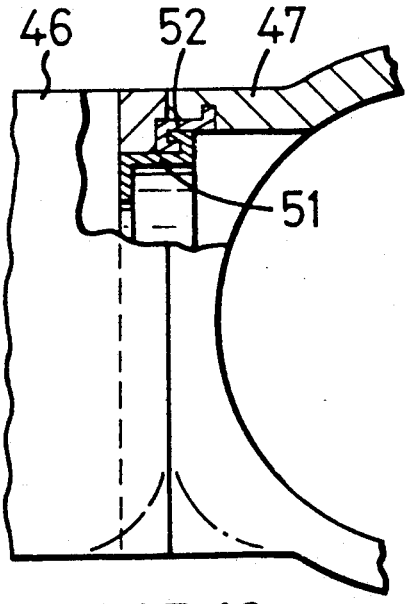
FIGS. 12 and 13 are part-sectional views illustrating respective alternative forms of swivel mechanism for use in the swivel coupler of FIG. 10.
Figure 13:
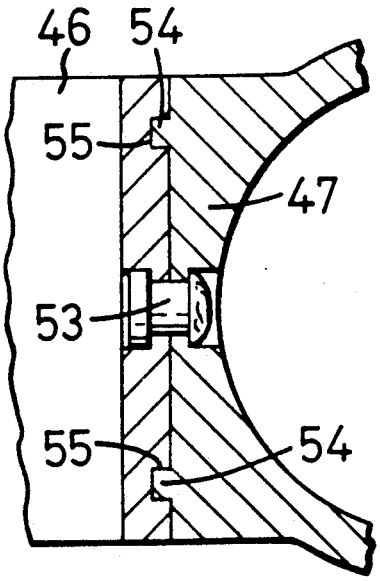

Alternative ways of providing the swivel interconnection of the base members 46 and 47, are illustrated in FIGS. 12 and 13. In the case of the modification of FIG. 12, two rings 51 and 52 that interlock with one another are moulded into, or are otherwise retained with, the members 46 and 47 respectively. On the other hand, in the case of the modification of FIG. 13, a central pin or rivet 53 is used, and strength against shear is afforded by the engagement of an annular projection 54 on the member 47 with an annular recess 55 of the member 46.

Figure 14:
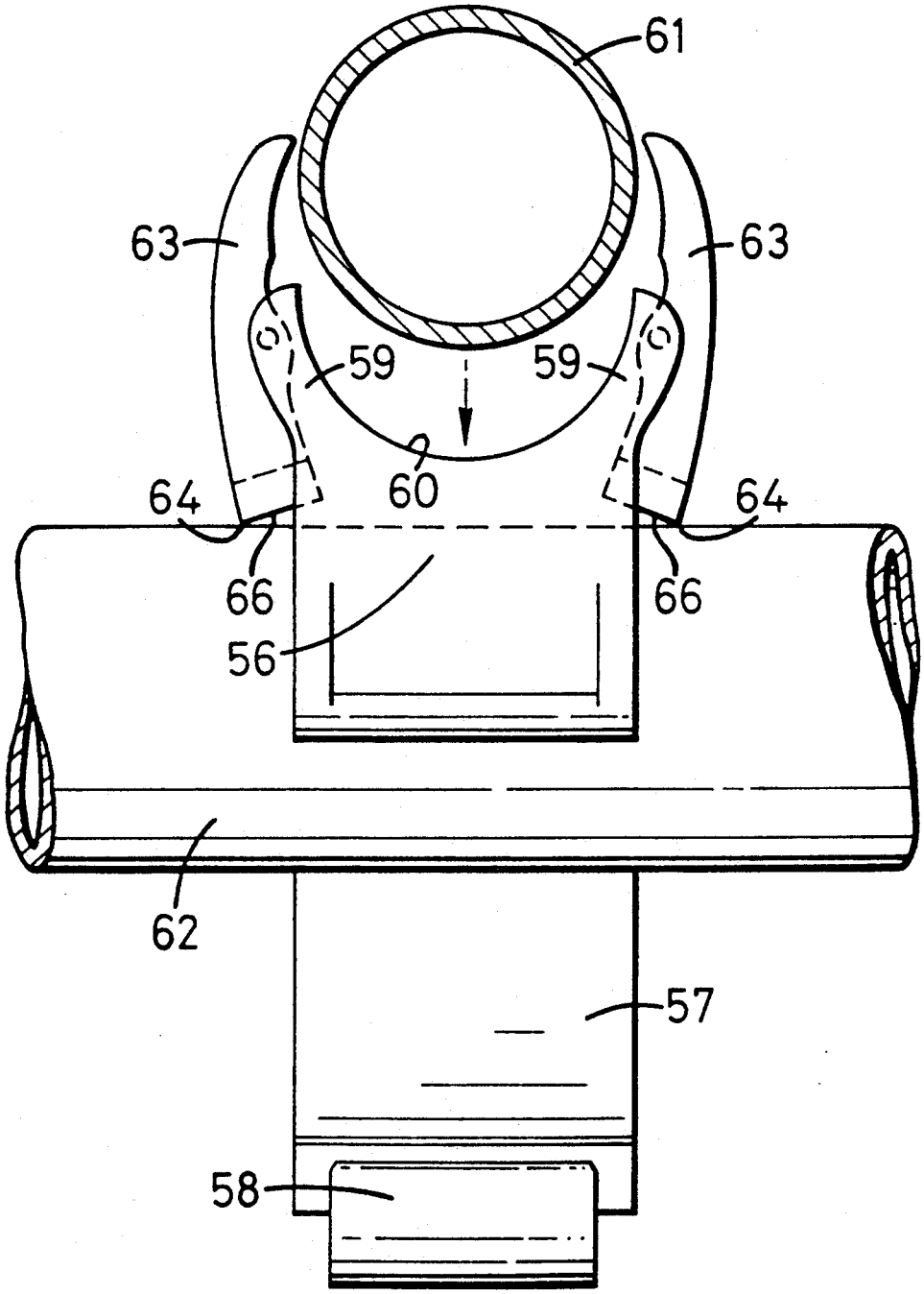
FIGS. 14 and 15 show, in side elevation, a so-called "non-load-bearing" or putlog scaffold-coupler according to the present invention, during successive stages in its use for intercoupling transverse scaffolding tubes.
Figure 15:
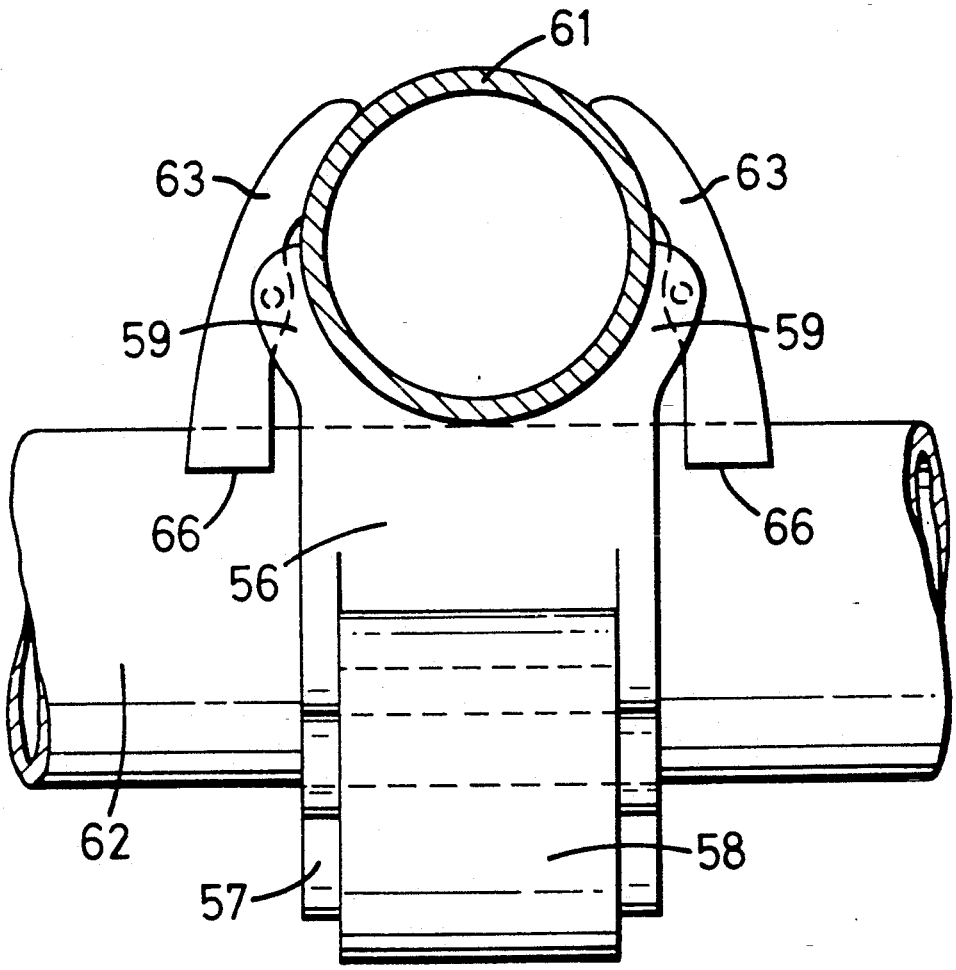
Figure 16:
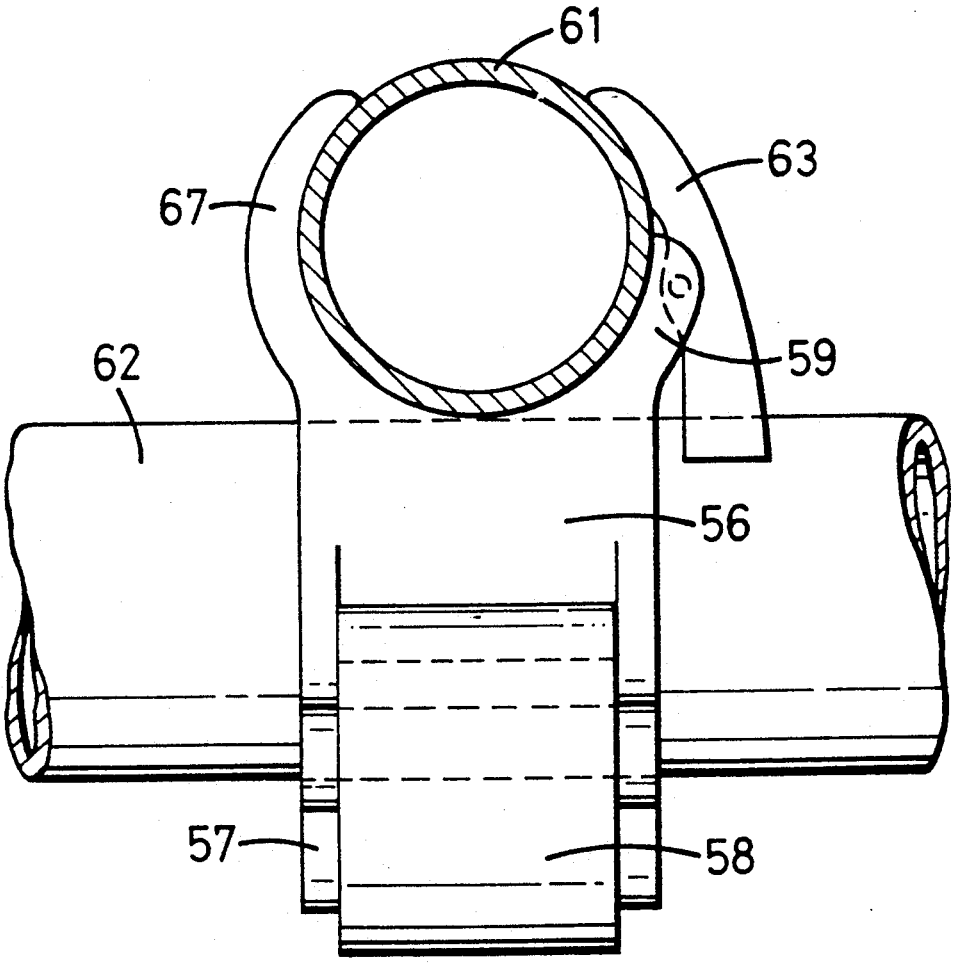
FIG. 16 illustrates a modified form of the putlog coupler of FIGS. 14 and 15.

Only one jaw assembly of the generic form described above, is utilised in the two constructions of putlog coupler illustrated in FIGS. 14 and 15, and FIG. 16, respectively. Both couplers are suitable for use, for example, at locations B of FIG. 1 where the transoms 4 cross ledgers 1.

Referring initially to FIG. 14, the base member (11) of the jaw assembly in this case, namely base member 56 with its attached closure jaw 57 and hook member 58, extends backwards into two opposed pairs of arms 59. The two pairs of arms 59 define between them a cylindrically-concave surface 60 running across the back of the member 56 to receive a transom 61 at right angles to a ledger 62. The member 56 rests on, but at this stage is not snapped onto, the ledger 62, with the jaw 57 hanging open.

A lever 63 is hinged between each pair of arms 59, for contacting the transom 61 within the coupling. Each lever 63 has a heal portion 64 that rests on the ledger 62 in this condition, so that the jaws formed between the levers 63 are open to receive entry of the transom 61 onto the surface 60. The coupler, or the transom 61, is now pressed down to snap the base member 56 fully onto the ledger 62 as shown in FIG. 15.

Referring to FIG. 15, the snapping of the base member 56 down onto the ledger 62 causes contact between each lever 63 and the ledger 62 to be transferred from its heal portion 64, to its full, curved foot 66. Such transfer causes both levers 63 to pivot, closing them up onto the transom 61. The jaw 57 is now closed up onto the ledger 62, the hook member 58 engaged and the over-centre mechanism actuated to clamp the coupling firmly to the ledger 62, as shown in FIG. 15. The securing of the coupling to the ledger 62 in this way ensures, through the abutment of the levers 63 on the ledger 62, that the transom 61 is securely held within the jaws of the levers 63, to the ledger 62.

Release of the transom 61 is brought about by releasing the coupling from the ledger 62 so that the abutment between the levers 63 and the ledger 62 is relaxed. This allows the levers 63 to hinge away from the transom 61 releasing their grip on it and enabling the transom 61 to be lifted free from the coupling.

Two hinged levers 63 are involved in the putlog coupler described above with reference to FIGS. 14 and 15. By way of alternative, just one such lever may be used, and the coupler shown in FIG. 16 illustrates such a modification.

Referring to FIG. 16, the modification in this case involves replacement of one pair of arms 59 and their hinged lever 63, by a fixed jaw 67 opposed to the remaining pair of arms 59 and their lever 63. The action of this modified putlog coupler is essentially the same as that of the coupler described with reference to FIGS. 14 and 15, except that in this case clamping of the transom 61 results from the hinging of the one lever 63 to hold it against the stationary jaw 67. The lever 63 in each case is secured between its pair of arms 59 using pin-in-socket hinge connections similar to those used in the over-centre mechanism, and its grip on the transom may be enhanced by providing an abrasive surface where contact is made.

Two jaw assemblies of the generic form are utilised in the construction of a sleeve coupler suitable for use, for example, at the locations E of FIG. 1 where ledgers 1 and standards 2 are made up from tubes intercoupled end to end. A sleeve coupler constructed in this way is illustrated in FIGS. 17 and 18.

Figure 17:
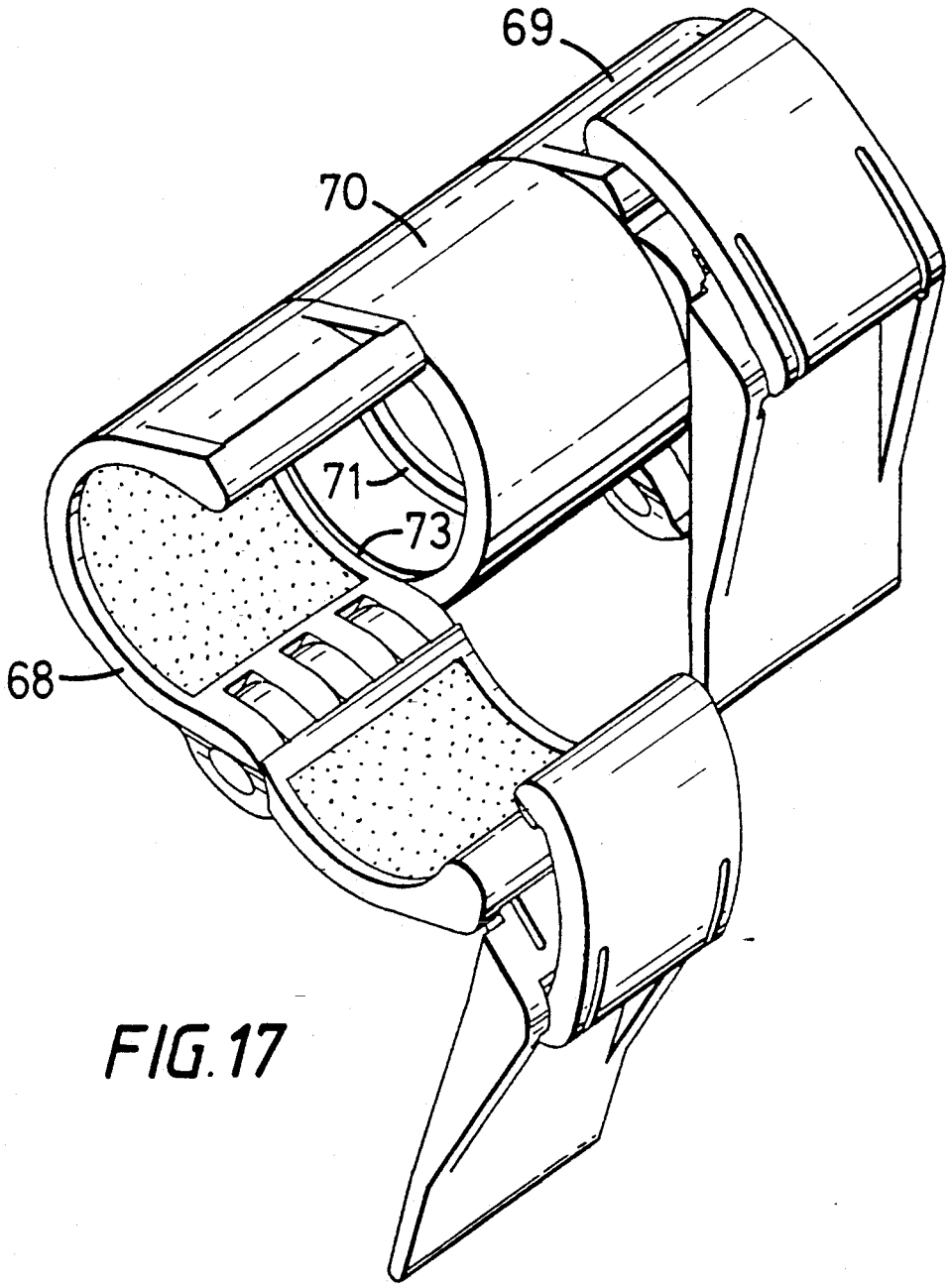
FIGS. 17 and 18 are a perspective view and a partial longitudinal section, respectively, of a sleeve scaffold-coupler according to the present invention, based on the form of jaw assembly shown in FIGS. 2 to 4.
Figure 18:
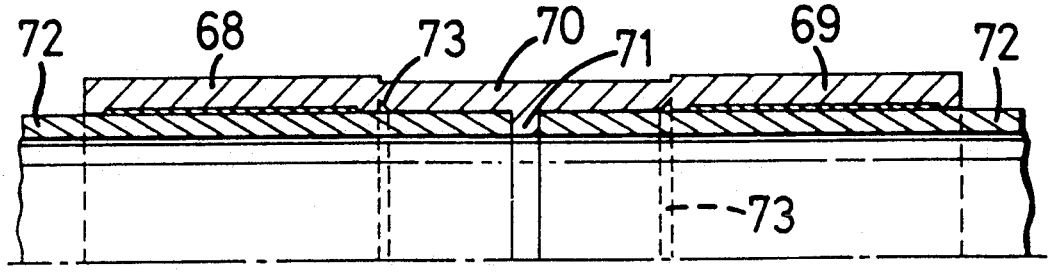

Referring to FIGS. 17 and 18, the base members (11) of the two jaw assemblies in this case are formed as one, side by side. The coupler in this case is generally tubular with the two base members, namely members 68 and 69 conforming externally to the tubular configuration and being interconnected side by side in axial alignment via an intermediate sleeve 70. A radially projecting shoulder 71 within the sleeve 70 provides a stop that limits tube-insertion. The two ledger or standard tubes 72 (FIG. 18) inserted into the coupler from either end abut the shoulder 71 to ensure adequate, and equal, insertion of both in the coupler; the arcuate lip 73 of the sleeve 70 at either end is chamfered to facilitate tube insertion. The two clamping assemblies operate independently of one another so that the coupler is clamped to the two axially-aligned tubes 72 individually.

In certain constructions of coupler where the material of the base member (11) is sufficiently flexible, it is possible for the closure jaw (12) to be incorporated unitarily with it, the function of the hinge (16) between them, then being fulfilled by the flexibility of the material. This technique is especially, though not exclusively, applicable in the provision of a sleeve coupler. More particularly, in this case the sleeve coupler can be provided by a tubular sleeve that is formed at either end with a slot running parallel to the sleeve axis over approximately one third of the sleeve length. One edge of the slot can be turned back as a lip for engagement by the hook member of a respective over-centre lever mechanism. The hand lever of this mechanism is hinged to the other edge of the slot, and freedom for opening and closing there is provided by an arcuate slot that runs from this edge circumferentially of the sleeve to an extent to define the closure jaw (12) of the coupling. The opposed jaw surfaces in this case, namely, the merging internal-surface sectors that extend in opposite circumferential directions from the axial slot, are pulled inwardly towards one another by actuation of the over-centre mechanism, flexing the sleeve wall.

The jaw assemblies of any or all of the couplers described above may be modified to include provision for positively securing the assembly in the clamped condition. For example, a toggle or other device may be provided which is selectively operable to lock the actuating hand-lever in its "over-centre" position and prevent it from being accidentally displaced to release the clamping action. FIGS. 19 to 24 illustrate how such locking may be provided, in relation to the generic form of coupler assembly.

Referring to FIGS. 19 and 20, a toggle device 74 is rotatably mounted on the closure jaw 12 to project through a slot 75 in the lever 13 and to be turned to lock the lever 13 closed down onto the jaw 12 in the actuated or "over-centred" condition of the over-centre lever mechanism. The turned toggle device 74 prevents the lever 13 being lifted unintentionally, for example by being kicked or otherwise struck accidentally, to release the clamping action of the assembly. When the clamping action is to be released, the toggle device 74 is turned by hand into alignment with the slot 75 so that the lever 13 can be lifted clear of the toggle device 74.

Depression of the lever 13 in renewing the clamping action, brings it down again over the toggle device 74 to the condition in which the device 74 projects through the slot 75 and can be turned by hand to lock the lever 13.

The toggle device 74 may simply comprise, as illustrated in FIG. 19, a plastics moulding that has a barbed split-stem 76 for clipping into the jaw 12 through an aperture 77. The jaw 12 may be built up slightly (as illustrated in FIG. 19) around the aperture 77; the handle 13 too, may have a conical moulding built up around the toggle 74 to protect it from accidental damage.

An alternative locking device and its operation are illustrated in FIGS. 21 to 24, and will now be described.

Figure 24A:
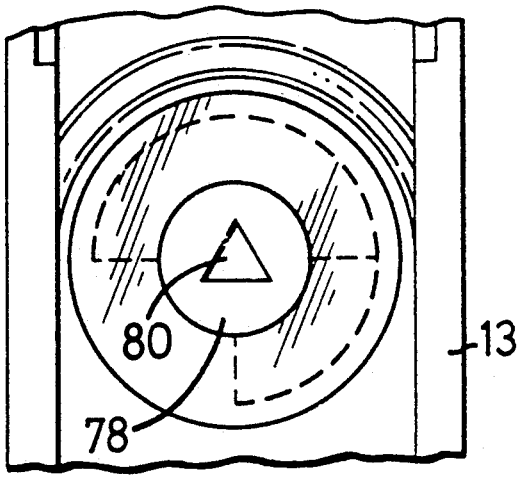
Figure 24B:
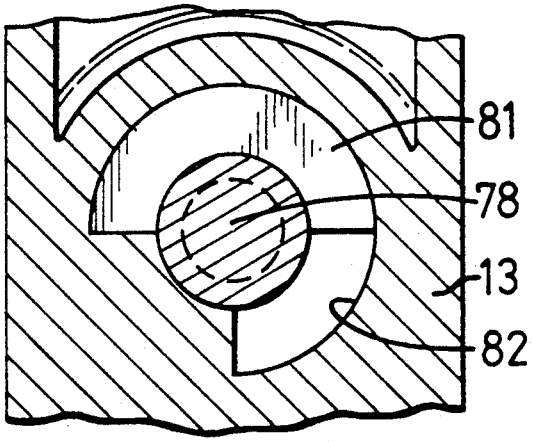
Figure 24C:
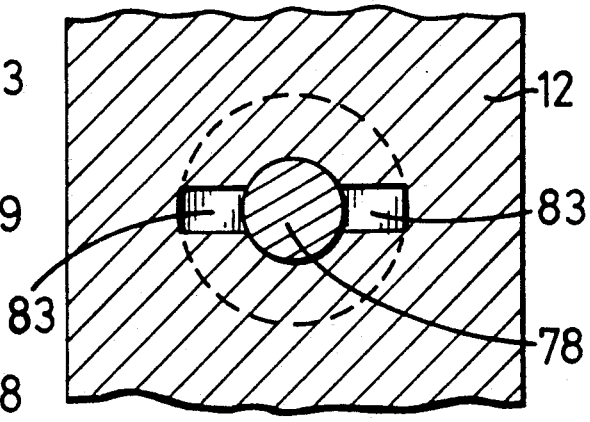

Referring to FIGS. 21 to 24, the locking device in this case involves a locking spigot 78 that is carried by the lever 13 to enter a slot 79 in the wall of the closure jaw 12. The mounting of the spigot 78 on the lever 13 allows the spigot 78 to be turned using a key (not shown) engaged within a triangular- or other-shaped recess 80 (FIGS. 23 and 24). Rotation of the spigot 78 in this respect, is limited to a quarter turn between "locked" and "unlocked" conditions, by a semicircular-piece 81 that is carried by the spigot 78 to move within a sector-cavity 82 of 270 degrees.

Radial projections 83 on the spigot 78 engage with the jaw 12 in the "locked" condition to hold the lever 13 against the jaw 12; this condition is illustrated in FIGS. 21 to 23(*a*)–(*c*). If now the key is inserted into the recess 80 and rotated through a half turn to bring the spigot 78 into the "unlocked" condition, the projections 83 are aligned with the slot 79 and can be withdrawn from it, freeing the lever 13 for release; this condition is illustrated in FIGS. 24(*a*)–(*c*).

The over-centre mechanism described above, in particular in the context of the generic assembly described with reference to FIGS. 2 to 4, involves a hand lever (13) carrying a hinged hook member (14) and associated with a closure jaw (12). The function of the hook member may, however, be combined with that of the hand lever or with that of the closure jaw, without departing from the present invention. Examples of alternative constructions of jaw assembly implementing these possibilities, are illustrated in FIGS. 25 and 26, FIGS. 27 and 28 and FIG. 29.

Figure 25:
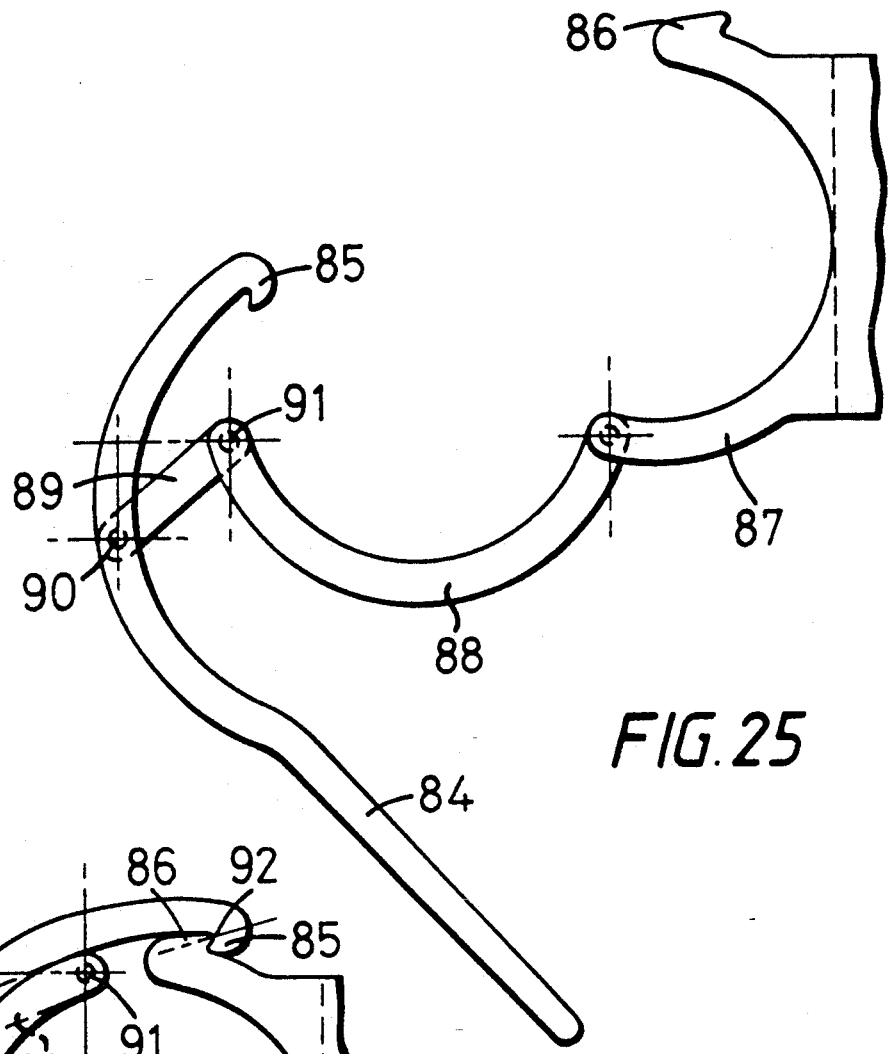
Figure 26:
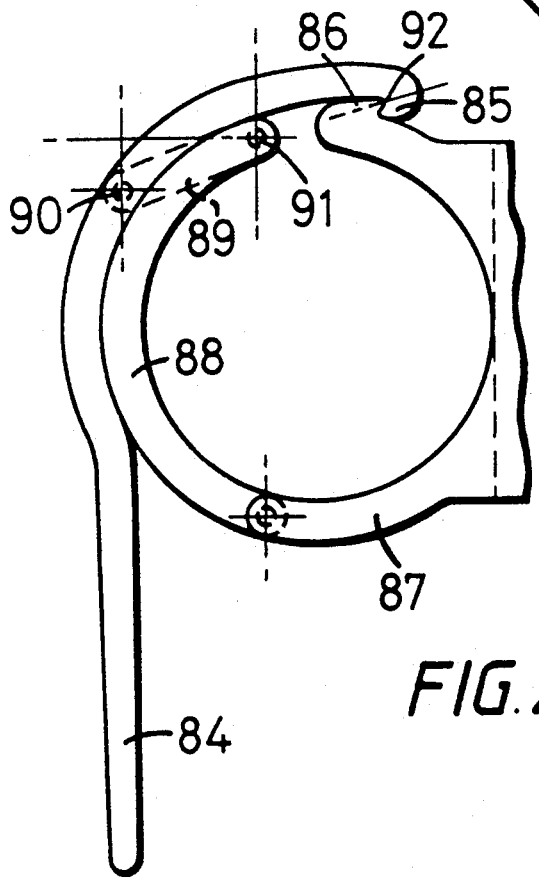

Referring to FIGS. 25 and 26, the hand lever 84 in this case is terminated by a hook portion 85 that is used to engage a turned-back lip 86 of the base member 87. The hand lever 84 is not hinged directly to the closure jaw 88 of the assembly, but rather to a short intermediate lever 89. The lever 89 is connected at one end to the lever 84 by a hinge 90, and at the other end to the jaw 88 by a hinge 91. When, from the condition shown in FIG. 25, the hook portion 85 has been engaged with the lip 86 to establish an effective hinge 92 (FIG. 26) there, depression of the lever 84 moves the hinge 90 downwardly until it finally comes into, and then snaps just beyond, alignment with the hinges 91 and 92. The assembly is now in the clamped condition shown in FIG. 26.

Figure 27:
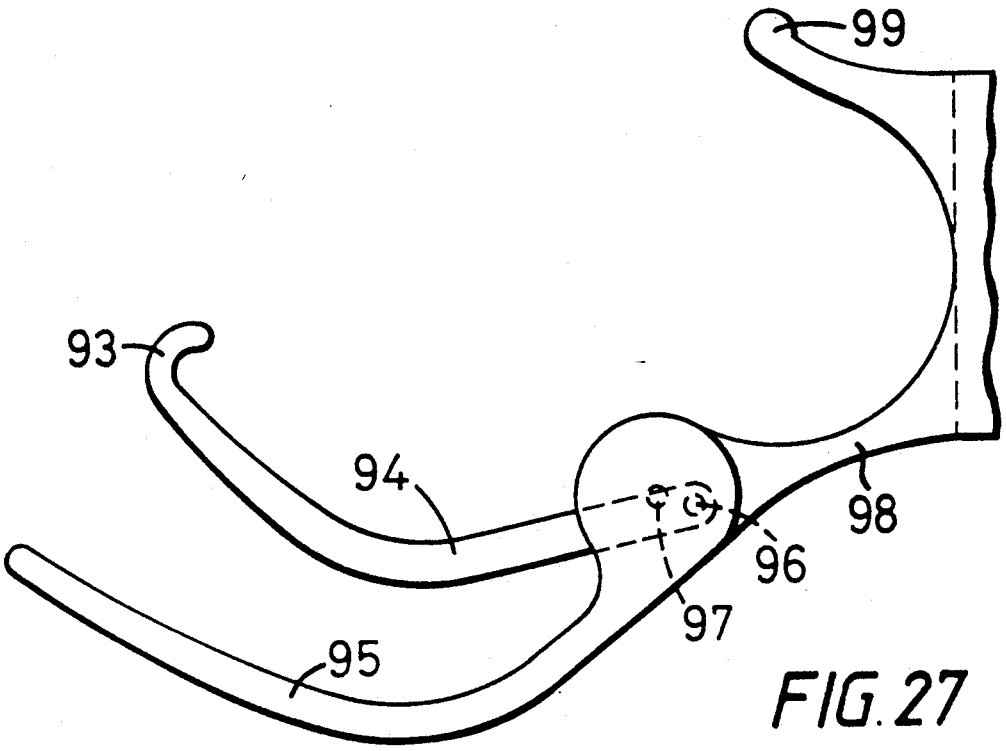
Figure 28:
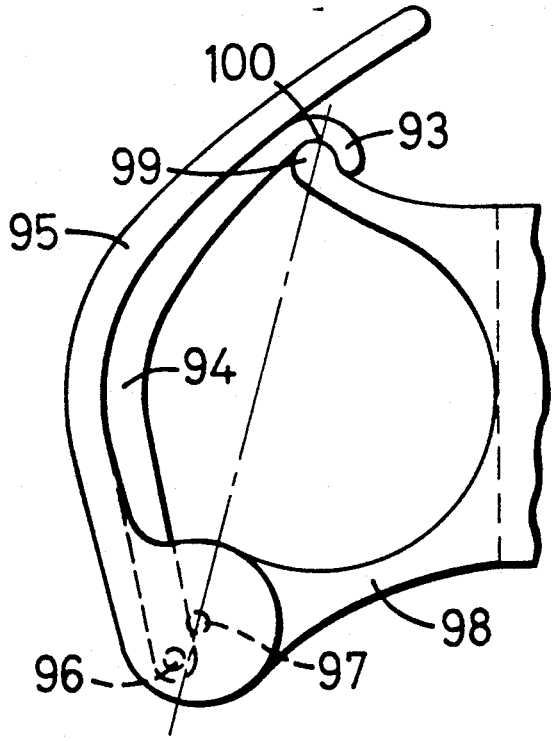

Referring to FIGS. 27 and 28, a hook portion 93 in this case terminates the closure jaw 94, and the hand lever 95 is coupled to the jaw 94 by means of a hinge 96 which is only slightly displaced from a hinge 97 between the lever 95 and the base member 98 (there is no hinge directly between the closure jaw and base member in this case). From the fully open condition shown in FIG. 27, the jaw 94 is first closed up to engage the hook portion 93 with the turned-back lip 99 of the base member 98. The hand lever 95 is now depressed towards the jaw 94 bringing the hinge 96 into, and then through, alignment with the hinge 97 and an effective hinge 100 at the lip 99, to establish the clamped condition shown in FIG. 28.

Figure 29:
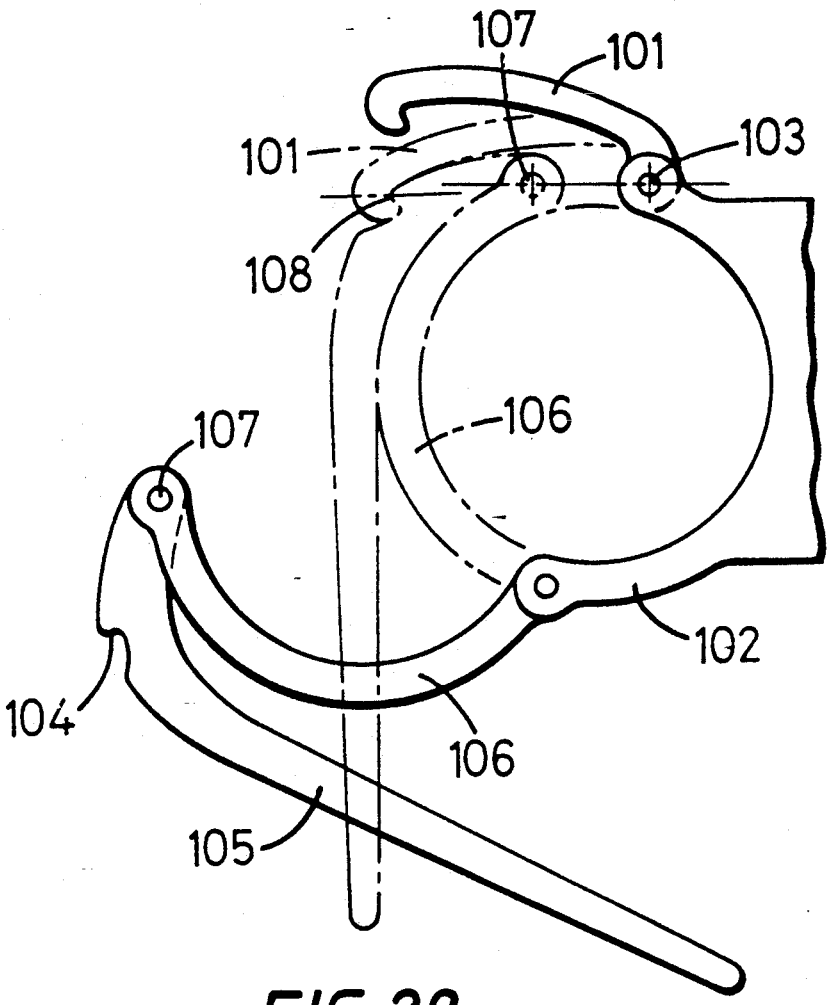

The form of assembly shown in FIG. 29, differs from the generic form described with reference to FIGS. 2 to 4, only in that the hook member 101 is permanently coupled to the base member 102 at a hinge 103, and engages with a lip 104 on the hand lever 105. Once the closure jaw 106 has been closed up and the hook member 101 engaged (as illustrated in broken outline in FIG. 29), the lever 105 is depressed about its hinge 107 with the jaw 106. Continued depression brings the effective hinge 108 at the lip 104 into and through alignment with the hinges 103 and 107 to lock the lever 105.

Many other variations and modifications to the specific forms of jaw assemblies and embodying couplers described above, may be made. Moreover, it will be appreciated that although the couplers have been illustrated as establishing intercouplings between scaffolding tubes of equal diameters, the coupler principles used may readily be adapted to the intercoupling of tubes of differing diameters. Furthermore, where plastics materials are utilised in the constructions of the couplers, the different forms of couplers may be more noticeably distinguished from one another by the introduction of distinctive marking, for example coloring, as between one class and another. Color or other marking may also, or in the alternative, be used with advantage as a means of indicating ownership and thereby deter theft of couplers from building and other scaffolding sites.

The scaffold couplers described above are intended for use with conventional scaffolding tubes (having diameters ranging from about 35 mm to about 80 mm), but the present invention is also applicable where tubes of smaller diameter are used, for example, in the construction of exhibition stands or other temporary space-frames. Furthermore, especially where smaller-diameter tubes (for example, of 10 mm diameter) are used, the invention may find application in educational or leisure activities.

I claim:

1. A scaffold coupler for clamping to tubes or other scaffolding elements to hold them to one another, comprising a base member, a closure member hinged to the base member, said base member and closure member having opposed cylindrically-concave surfaces to define a pair of jaws for gripping a first of said scaffolding elements, abrasive particles bonded to said cylindrically-concave surfaces for enhancing the grip of said jaws on said first scaffolding element, and said closure member being hinged to the base member as aforesaid for movement of the closure member towards the base member in closing the jaws upon said first scaffolding element, an over-centre lever mechanism for intercoupling the base member and the closure member, said over-centre lever mechanism being selectively actuatable when intercoupling the base and closure members to close and clamp the jaws onto said first scaffolding element, and means for clamping the coupler to a second of said scaffolding elements so as to intercouple the first and second scaffolding elements.

2. A scaffold coupler according to claim 1 wherein the over-centre lever mechanism includes a hand lever that is hinged to the closure member and a hook member that is hinged to the hand lever, and wherein the hook member is selectively engageable with the base member, and said over-centre lever mechanism is selectively actuable to bring about clamping by turning the hand lever about its hinge with the closure member while the hook member is engaged with the base member.

3. A scaffold coupler according to claim 1 including means for limiting the angular extent of hinging of the closure member relative to the base member to about 90 degrees to provide support for the tube or other scaffolding element prior its engagement with the base member.

4. A scaffold coupler according to claim 1, wherein said abrasive particles comprise a material different from the material of said base and said closure members.

5. A scaffold coupler for coupling two tubes or other scaffolding elements to one another in a scaffolding structure, comprising two interconnected means for clamping to respective ones of said elements to hold those elements to one another, wherein at least one of said clamping means comprises a pair of hinged jaws to embrace the respective tube or other scaffolding element for establishing a clamped intercoupling therewith, and an over-centre lever mechanism that is selectively actuable to close and clamp the jaws onto said element, the jaws having respective ends hinged together and each having a free end remote from its hinged end, a first of said jaws defining a cylindrical clamping surface that subtends more than 180 degrees between its free and hinge ends to provide a partially closed mouth to the jaw, said first jaw having resilience to enable said mouth to be snapped over said tube or other scaffolding element for initial retention of said first jaw engaged with that element prior to closing of said second jaw upon said engaged element and actuation of the lever mechanism, the second of the two jaws subtending less than 180 degrees between its free and hinge ends to define a gap between its free end and the free end of said first jaw when said second jaw is closed upon said engaged element within said mouth, and said over-centre lever mechanism is actuable when the second jaw is closed upon said engaged element to urge the free ends of the first and second jaws towards one another across said gap.

6. A scaffold coupler according to claim 5 wherein the two clamping means operate in orthogonal planes to provide a right-angle coupler.

7. A scaffold coupler according to claim 5 wherein the two clamping means are located closely side by side in line with one another to provide a sleeve coupler for coupling the two tubes or other scaffolding elements together end to end.

8. A scaffold coupler according to claim 5 including a swivel coupling between the two clamping means to enable their relative orientation to be varied.

9. A scaffold coupler according to claim 5 including a lever that is for angular displacement to actuate the over-centre mechanism in closing and clamping the jaws onto said element, a member for linking the lever to one of the jaws, means for establishing a first effective hinge connection between said linking member and the actuating lever, means for establishing a second effective hinge connection between the lever and one of the jaws, and means for establishing a third effective hinge connection between the linking member and the other jaw, said over-centre mechanism including means providing resilient bias to oppose actuation of said mechanism, and displacement of the lever for actuating the mechanism as aforesaid causing the first hinge connection to be moved into alignment with the second and third hinge connections against said resilient bias and to snap through such alignment to be retained there with the jaws clamped onto said element.

10. A scaffold coupler according to claim 9 wherein the third effective hinge connection is a selectively disengageable connection between said other jaw and said linking member, and in which said displacement of the actuating lever acts via the disengageable connection to pull the two jaws towards one another across said gap so as to close and clamp them more tightly onto said element as the first hinge moves into said alignment.

11. A scaffold coupler comprising jaw means defining a pair of jaws that are closable to embrace a tube or other scaffolding element for establishing a clamped intercoupling therewith; an over-centre mechanism that is selectively actuable to close and clamp the jaws onto said element, said over-centre mechanism including a lever for deflection relative to said jaw means to close the jaws onto said element; and a locking device that is selectively operable when the lever is in its deflected position to interlock a part of the lever with a part of said jaw means for holding the over-centre mechanism against release from its actuated condition, said locking device including a member carried by one of said parts to project towards the other part, and wherein said other part defines an aperture facing said one part for receiving said member, said member projecting into the aperture from said one part when the lever is in its deflected position, and operation of the locking device traps said member within the aperture.

12. A scaffold coupler comprising two clamping means to embrace respective tubes or other scaffolding elements for establishing a clamped intercoupling between the elements, each said clamping means comprising a pair of jaws for embracing the respective element, a hinge intercoupling the two jaws of the pair and a mechanism that is selectively actuable to close and clamp the jaws onto said element, each of the jaws having a free end remote from said hinge and being recessed between its free end and the hinge to define a surface for establishing clamping abutment with said element, said surface of a first of the jaws subtending more than 180 degrees to provide a partially closed mouth to the jaw recess, and said first jaw having resilience to enable said mouth to be snapped over said element for initial retention of said first jaw engaged with that element prior to actuation of said mechanism to close the second jaw upon the engaged element and effect clamping of the jaws thereon, and wherein said surface of said second jaw subtends less than 180 degrees to define a gap between its free end and the free end of said first jaw when said second jaw is closed upon said engaged element, and said mechanism is actuable when the second jaw is closed upon said engaged element, to urge the free ends of the first and second jaws towards one another across said gap.

13. A scaffold coupler comprising two independently-operable jaw means for clamping to respective tubes or other scaffolding elements and holding said elements together substantially at right angles to one another, the jaw means including a base member that is common to both jaw means and defines two cylindrically-concave surfaces set substantially at right angles to one another for receiving respective ones of said elements, wherein each of said jaw means includes a closure member having a cylindrically-concave surface, means to hinge said closure member to said base member for movement to close the concave surface of the closure member upon a respective one of the cylindrically-concave surfaces of said base member to define thereby a pair of jaws for receiving and gripping the respective scaffolding element between those concave surfaces, and an over-centre lever mechanism for selective actuation between the base member and the closure member to close and clamp the jaws onto that scaffolding element, said base member being of a unitary construction of resilient plastics material to provide compliance for enhancing the grip of the jaws on the clamped element under load, and wherein abrasive particles are bonded to said cylindrically-concave surfaces of said base member for enhancing the grip of each said jaw means on its respective scaffolding element.

14. A scaffold coupler for coupling two tubes or other elongate scaffolding elements to one another in a scaffolding structure, comprising two interconnected clamping means for clamping to respective ones of the elements to hold those elements together substantially at right angles to one another, each said clamping means comprising: a pair of jaws to embrace the respective tube or other scaffolding element for establishing a clamped intercoupling therewith; an over-centre lever mechanism that is selectively actuable to close and clamp the jaws onto said element, said over-centre mechanism including means providing resilient bias to oppose said actuation, and an actuating lever for angular displacement to actuate the mechanism in closing and clamping the jaws onto said element; a linking lever; a first hinge connection between the actuating lever and the linking lever; a second hinge connection effective between the actuating lever and one of the jaws, said second hinge connection comprising a selectively-disengageable hook interconnection between the actuation lever and said one jaw; and a third hinge connection between the other jaw and the linking lever; said displacement of the actuating lever causing the first hinge connection to be moved into alignment with the second and third hinge connections against said resilient bias and to snap through such alignment to be retained there with the jaws clamped onto said element; the coupler including a unitary base member common to both said clamping means, and wherein the said one jaw of each said pair of jaws is defined in said unitary base member.

15. A scaffold coupler comprising: a pair of jaws, each jaw having a concave surface abutting a respective portion of a tube or other scaffolding element embracing the tube or other scaffolding element for establishing a clamped intercoupling therewith; an over-centre lever mechanism that is selectively actuatable to close and clamp the jaws onto said element, said over-centre mechanism including means providing resilient bias to oppose said actuation, and an actuating lever for angular displacement to actuate the mechanism in closing and clamping the jaws onto said element; a first hinge connection; a second hinge connection between the actuating lever and one of the jaws, the first hinge connection being between the actuating lever and the other jaw; and a third hinge connection effective between the two jaws themselves, said third hinge connection comprising a selectively-disengageable hook interconnection between the two jaws; said displacement of the actuating lever causing the first hinge connection to be moved into alignment with the second and third hinge connections against said resilient bias and to snap through such alignment to be retained there with the jaws clamped onto said element.

16. A scaffold coupler comprising: a pair of jaws to embrace a tube or other scaffolding element for establishing a clamped intercoupling therewith; an over-centre lever mechanism that is selectively actuable to close and clamp the jaws onto said element, said over-centre mechanism including means providing resilient bias to oppose said actuation, and an actuating lever for angular displacement to actuate the mechanism in closing and clamping the jaws onto said element; a linking member; a first hinge connection effective between the actuating lever and the linking member, said first hinge connection comprising a selectively-disengageable hook interconnection between the actuation lever and the linking member; a second hinge connection between the actuating lever and one of the jaws; and a third hinge connection between the other jaw and the linking member; said displacement of the actuating lever acting via the disengageable connection to pull the two jaws towards one another and causing the first hinge connection to be moved into alignment with the second and third hinge connections against said resilient bias and to snap through such alignment to be retained there with the jaws clamped onto said element.

* * * * *